US007053367B2

(12) United States Patent
Tobita et al.

(10) Patent No.: US 7,053,367 B2
(45) Date of Patent: May 30, 2006

(54) MASS SPECTROMETER

(75) Inventors: Tomoyuki Tobita, Hitachinaka (JP); Toshihiro Ishizuka, Hitachinaka (JP); Masaru Tomioka, Hitachinaka (JP); Kiyomi Yoshinari, Hitachi (JP); Masami Sakamoto, Hitachinaka (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

(21) Appl. No.: 10/494,335

(22) PCT Filed: Nov. 7, 2001

(86) PCT No.: PCT/JP01/09729

§ 371 (c)(1),
(2), (4) Date: Apr. 30, 2004

(87) PCT Pub. No.: WO03/041115

PCT Pub. Date: May 15, 2003

(65) Prior Publication Data

US 2004/0262512 A1 Dec. 30, 2004

(51) Int. Cl.
*H01J 49/00* (2006.01)

(52) U.S. Cl. ..... 250/288; 250/287; 250/423 R; 250/281; 250/282; 250/292

(58) Field of Classification Search ..... 250/288, 250/287, 423 R, 281, 282, 292
See application file for complete search history.

(56) References Cited

U.S. PATENT DOCUMENTS 6,252,225 B1 * 6/2001 Takada et al. ..... 250/288
6,392,226 B1 * 5/2002 Takada et al. ..... 250/292

FOREIGN PATENT DOCUMENTS

JP 5-203637 8/1993
JP 6-331616 12/1994
JP 2001-101992 4/2004

OTHER PUBLICATIONS

JP 11281621 A, "Liquid Chromatograph and Mass Spectrometer", Assignee: Hitachi Ltd., Pub. date: Oct. 15, 1999.*

* cited by examiner

*Primary Examiner*—Nikita Wells
*Assistant Examiner*—Zia R. Hashmi
(74) *Attorney, Agent, or Firm*—Dickstein Shapiro Morin & Oshinsky LLP

(57) ABSTRACT

In a mass spectrometer utilizing an atmospheric pressure ion source, the amount of un-vaporized droplets that reach a mass spectrometric section is reduced. A mass spectrometer comprises: an ionization section for ionizing a sample at substantially atmospheric pressure; a first and a second intermediate pressure section in which the pressure is maintained lower than the pressure in said ionization section; a high vacuum section in which the pressure is maintained lower than the pressure in said intermediate pressure section and in which a mass spectrometric means for subjecting ions to mass spectrometry is disposed; a first pore electrode disposed between said ionization section and said first intermediate pressure section; an intermediate pore electrode disposed between said first intermediate pressure section and said second intermediate pressure section; and a second pore electrode disposed between said second intermediate pressure section and said high vacuum section. A first converging electrode is provided in the first intermediate pressure section, the first converging electrode having an opening towards the first pore electrode and another opening towards the intermediate pore electrode. The opening towards the first pore electrode has a larger diameter than the opening towards the intermediate pore electrode, such that the first converging electrode has a tapered shape.

17 Claims, 15 Drawing Sheets

*. V1, V1d, V2d, AND V2 ARE ZERO
*. CONVERGING ELECTRODES
7 AND 8 ARE ELIMINATED

MASS SPECTROMETER

FIELD OF THE INVENTION

The present invention relates to a mass spectrometer and, in particular, to the structure of a differential exhaust section.

BACKGROUND ART

In recent years, mass spectrometers are increasingly used as a means of detecting trace components in gases or liquids with high sensitivity. Mass spectrometers now constitute indispensable measurement and analysis equipment in fields that require ultramicro analysis.

In this type of equipment, a sample to be measured is ionized and resultant ions are analyzed in a mass spectrometric section. As a means of realizing a more sensitive microanalysis, a mass spectrometer utilizing atmospheric pressure ionization (to be hereafter referred to as APCI), particularly a liquid chromatograph mass spectrometer (to be hereafter referred to as LC/MS), is known.

In this apparatus, a mixture of substances to be measured, such as those that have been concentrated through predetermined preprocessing steps, is introduced into a liquid chromatograph (to be hereafter referred to as LC) and separated. The eluted sample and mobile phase are sent via piping such as a Teflon pipe to an atomization section, where they are heated and thereby atomized. The atomized sample and mobile phase are further turned into a molecular state and then ionized in an ionization chamber. The ionized mobile-phase molecules produce a molecular reaction with the sample molecules, and charges are transferred to sample molecules that have not yet been ionized, whereby the sample molecules are ionized gradually and almost entirely. The ionized sample molecules are delivered to a high-resolution mass spectrometric section for mass spectrometry. This apparatus is characterized in that a qualitative analysis of the measured substances can be performed based on the mass number of detected ions, and that a quantitative analysis of the measured substances can also be performed based on the intensity of detected ions.

A capillary electrophoresis/mass spectrometer (to be hereafter referred to as CE/MS) is also known, which employs capillary electrophoresis instead of LC.

Further, ion-trapping mass spectrometers are also becoming more and more common in recent years, in which an ion trap consisting of a pair of an end-cap electrode and a ring electrode is used in the mass spectrometric section of the mass spectrometer.

Examples of the ion-trapping mass spectrometer are disclosed in JP Patent Publication (Kokai) No. 8-166371 A (1996) and 8-178899 A (1996).

DISCLOSURE OF THE INVENTION

In the above-described LC/MS and CE/MS, droplets that are not completely vaporized exist in the sample including the measured substance. As a result, attempts to bring ions produced by an electrospray atmospheric pressure ion source or an APCI ion source into the ion-trapping mass spectrometric section lead to large quantities of neutral molecules containing the droplets being brought into the ion-trapping mass spectrometric section, together with the ions. This produces the following problems:

(1) The neutral molecules or droplets that enters the ion trap attach to the end cap electrodes in the ion-trapping mass spectrometric section, for example, thereby contaminating the electrodes or disturbing the internal high-frequency electric field. As a result, trapping of the ions could be prevented or the accuracy of mass spectrometry could be adversely affected.

(2) Due to the neutral molecules or droplets that enters the ion trap, charges move from the ions in the sample molecules to the droplets in the ion-trapping mass spectrometric section, or the droplets that exited from the ion-trapping mass spectrometric section reach a detector, resulting in a significant increase in noise.

In LC/MS or CE/MS, a sample solution is turned into charged droplets using an atmospheric pressure ion source, and the charged droplets are vaporized by heating, for example. However, the charged droplets cannot be completely vaporized, and, naturally, the droplets that have not been completely vaporized enter inside the ion-trapping mass spectrometric section surrounded by the two end-cap electrodes and one ring electrode, thereby producing the aforementioned problems.

Thus, there is a need to minimize the number of droplets that have not been vaporized by the atmospheric pressure ion source to reach the ion-trapping mass spectrometric section.

In recent years, there is also a need for increasing the sensitivity of microanalysis. This calls for allowing ions, as many as possible, from the measured sample ionized by any of the aforementioned atmospheric pressure ion sources to be transmitted to the mass spectrometric section (without attenuation) so that the signal intensity can be increased. Examples of such attempts to improve ion transmission efficiency are disclosed in JP Patent Publication (Kokai) Nos. 8-304342 A (1996), 11-64289 A (1999), and 2001-60447 A.

In these publications, ion focusing electrodes are disposed in the chamber (intermediate-pressure section) towards the high-pressure side of the differential exhaust section, to improve the efficiency of transmission of ions to the high-vacuum section.

Although in these examples consideration is given to the improvement of the efficiency of transmission of ions to the high-vacuum section, they do not take into consideration the issue of "how to minimize the number of droplets that have not been vaporized by an atmospheric pressure ion source to reach the ion-trapping mass spectrometric section".

It is therefore the object of the invention to provide a mass spectrometer with an improved efficiency of transmission of ions to the high-vacuum section, whereby the number of droplets that are not vaporized by an atmospheric pressure ion source to reach the mass spectrometric section can be minimized.

In order to achieve the aforementioned object, the invention provides a mass spectrometer comprising:

an ionization section for ionizing a sample at substantially atmospheric pressure;

a first and a second intermediate pressure section in which the pressure is maintained lower than the pressure in said ionization section;

a high vacuum section in which the pressure is maintained lower than the pressure in said intermediate pressure section and in which a mass spectrometric means for subjecting ions to mass spectrometry is disposed;

a first pore electrode disposed between said ionization section and said first intermediate pressure section;

an intermediate pore electrode disposed between said first intermediate pressure section and said second intermediate pressure section; and a second pore electrode disposed between said second intermediate pressure section and said high vacuum section, wherein:

ions produced in said ionization section are introduced via said first pore electrode, said intermediate pore electrode, and said second pore electrode to said high vacuum section, in which mass spectrometry is performed, and wherein:

a first converging electrode is provided in said first intermediate pressure section, said first converging electrode having an opening towards said first pore electrode and another opening towards said intermediate pore electrode, the opening towards said first pore electrode having a larger diameter than the opening towards said intermediate pore electrode, such that said first converging electrode has a tapered shape.

Preferably, the diameter of the opening of said first converging electrode towards said first pore electrode is not less than the diameter of a Mach disc produced in at least said intermediate pressure section, and the diameter of the opening of said first converging electrode towards said first pore electrode is more towards said intermediate pore electrode than a Mach disc plane produced in said first intermediate pressure section.

Preferably, a second converging electrode is provided in said second intermediate pressure section, said second converging electrode having a cylindrical shape and having the edge towards said second pore electrode formed with an acute angle.

By thus providing a first converging electrode or a second converging electrode, which characterize the present invention, the ion transmission characteristics can be significantly improved. By adopting the above-recited arrangement or positioning of the converging electrodes, cluster ions can be desolvated sufficiently, so that the cluster ions due to neutral molecules or droplets can be reduced as much as possible.

BEST MODE OF CARRYING OUT THE INVENTION

Figure 1:
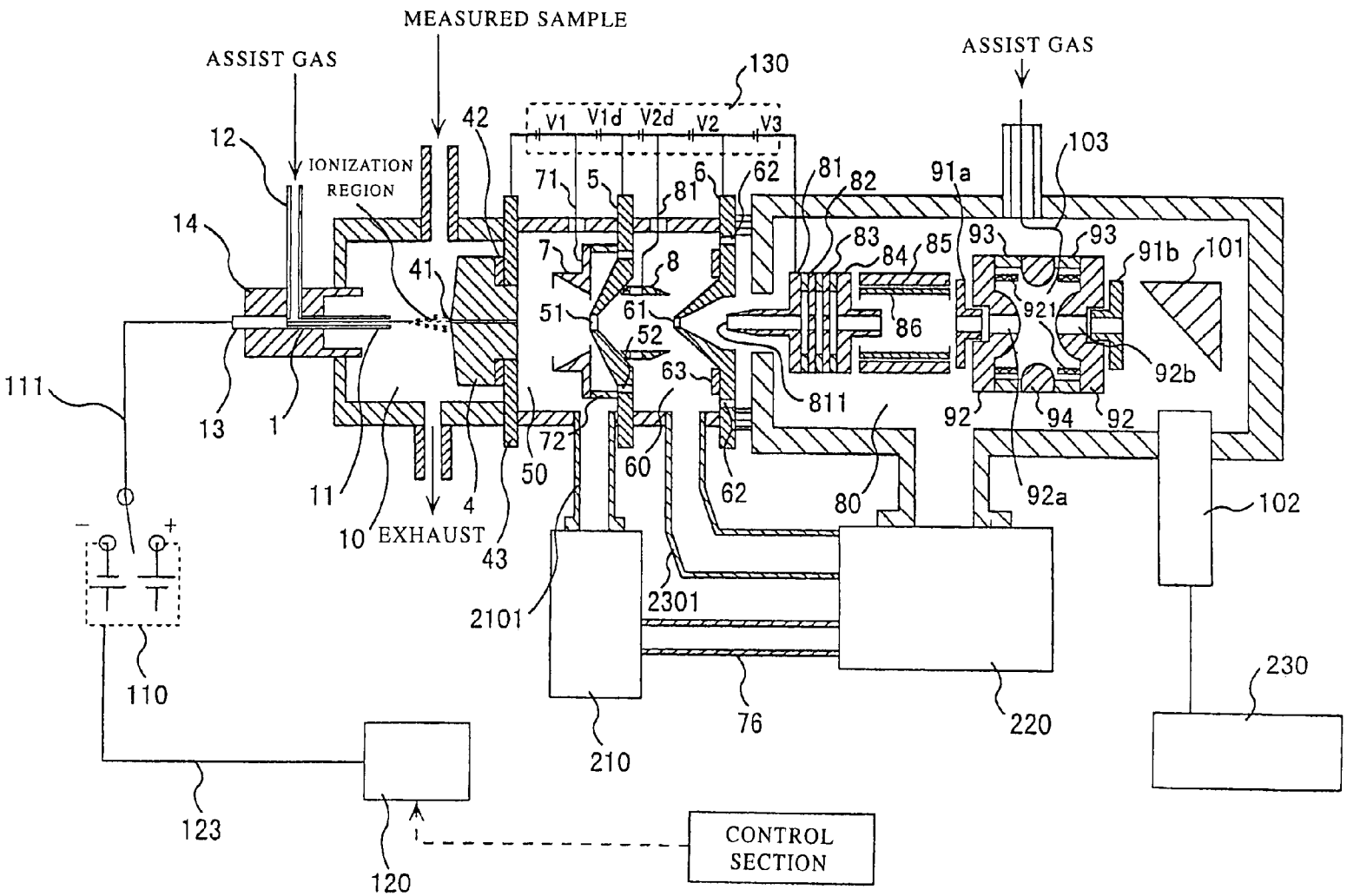
FIG. 1 is an overall view of the invention.

The embodiments of the invention will be described by referring to the drawings.

In the following, atmospheric pressure chemical ionization (APCI), which utilizes corona discharge produced by a needle electrode, will be used as an example of the atmospheric pressure ion source.

Alternatively, the present invention may also employ an electrospray atmospheric ion source (ESI) in which a sample liquid flowing out from a liquid chromatograph is sent via piping to an electrospray atmospheric pressure ion source equipped with a metal capillary and charged droplets are produced, whereby charged droplets are directly produced utilizing electrostatic spraying phenomenon.

As the means for separating a sample mixture, a liquid chromatograph utilizing a filler filled in a column may be used. Further, capillary electrophoresis, in which separation is conducted by means of capillary tubes, may also be used. The invention may be similarly adapted for flow injection analysis in which a sample solution is continuously introduced.

FIG. 1 shows the overall structure of the apparatus to which the differential exhaust chamber according to the invention is applied.

A sample containing water and droplets is introduced into an ionization chamber 10. Part of the sample is taken into a first pore 41 and the rest is discharged via a discharge opening. The flow volume introduced into the ionization chamber 10 is on the order of 1 to 2 L/min. The flow volume may be set by a mass flow controller. The sample introduced into the ionization chamber 10 is ionized in a corona discharge region produced between a first pore body 4 and a needle electrode 1 to which a high voltage is applied. The ionized sample is then taken into the first pore 41. The voltage applied to the needle electrode 1 is on the order of 1 to 6 kV when producing positive ions and −1 to −6 kV when producing negative ions. The voltage is supplied from a Hv power supply 110 with a constant voltage or current. The sample is ionized and produces a molecular reaction in the corona discharge region created between the first pore body 4 and the needle electrode 1, to which a high voltage is applied.

In order to ensure the durability and stability of the corona discharge section, the ionization section where the needle electrode 1 is positioned is equipped with a means of supplying a pure gas such as dry air or argon, for example, separately to the ionization section.

The needle electrode 1 is fixed at the tip of a needle holder pipe 11. A back gas supply pipe 12 is connected to one end of the needle holder pipe. To the other end of the needle holder pipe, an HV terminal 13 is connected for the supply of electric power.

At the tip of the back gas supply pipe 12, there are mounted a flow meter and a variable throttle device, for example, for controlling the volume of the back gas connection pipe, which delivers gas such as dry air or argon from the outside.

In this structure, pure gas such as dry air or argon is supplied to the tip of the needle electrode 1 always as a parallel flow via the needle holder pipe 11. In particular, when the supplied fluid is dry air, oxygen as a seed source for primary ionization can be continuously supplied to the corona discharge region, so that uniform primary ions can be produced that are not dependent on the concentration of oxygen in the sample gas. Thus, the coronal discharge is stable. Further, since the supplied gas functions as a shield gas that separates the needle tip portion, where the temperature is highest, stability can be further increased and the corrosion of the needle electrode 1 can be prevented.

While these ionized molecules should be taken into the initial stage of the differential exhaust chamber, which will be described later, the larger the size of the first pore 41 in the initial-stage portion of the differential exhaust chamber, the better is it. Generally, however, there is a limit to the exhaust performance of the pump equipped in the differential exhaust chamber, and therefore the pressure is set on the order of 1 to 50 Torr.

As described above, the positive or negative ions that have been produced are taken into the first pore 41. In accordance with the present invention, in such a differential exhaust chamber that the shape and disposition of the exhaust system is adapted to cause the ions that are taken into the first pore 41 to be passed through vacuum chambers with gradually decreasing pressures and further into the mass spectrometric section (chamber) of the high vacuum chamber, the ion transmission ratio can be improved and the influence of the cluster ions produced by the influence of water or droplets contained in the sample can be eliminated.

In the following, the differential exhaust chamber will be described by referring to FIGS. 1 and 2.

The sample ions that are ionized at atmospheric pressure are introduced, via the first pore 41 of the differential exhaust chamber, into a low-vacuum chamber (first chamber 50, with a pressure P1) in the initial stage, where the pressure is lower than the atmospheric pressure. The gas molecules then form a supersonic jet, producing a shock wave that depends on the pressure (P1) in the first chamber 50 and a Mach disc plane (dB1) (see FIG. 2B).

Namely, the gaseous molecules that are introduced into the first chamber 50 via the first pore 41 from the atmospheric pressure are rapidly cooled down by adiabatic expansion, adiabatically compressed and rapidly heated in the Mach disc plane (dB1).

As to the shape of such a shock wave, experimental formulae for finding the size (Mach disc size) dB of the shock wave and the position Xm in the Mach disc plane are obtained, as described in Transactions of the Japan Society of Mechanical Engineers (B), vol. 50, No. 449 (Showa 59-1), pp. 223 to 240, as follows:

$$dB=0.78\times d1\times(P0^{\gamma}/P1)^{0.41} \quad (1)$$

$$Xm=0.28\times d1\times(P0/P1)^{0.68} \quad (2)$$

where P0 is the atmospheric pressure, P1 is the pressure in the first chamber 50, and d1 is the size of the first bore 41. The mean free path and Knudsen number corresponding to the molecular pressure can be expressed by the following equations:

$$\lambda=0.05/Pi \quad (3)$$

$$Kn=\lambda/di \text{ (Knudsen number: index of molecular flow and viscous flow)} \quad (4)$$

Kn<1 Nozzle beam flow (viscous flow)
Kn>=1 Molecular flow where Pi is the pressure of a vacuum chamber, and di is the size of the pore provided.

Equation (3) indicates the mean free path of the molecules in the differential exhaust chamber and is expressed as a function of pressure. There is additionally the Knudsen number (Kn) as a distinguishing index for nozzle beam flow and molecular flow, as shown by equation (4). When Kn<=1, if the gas is ejected from the pore such as nozzle into vacuum, the molecules in the gas collide with one another and expand adiabatically. At the end of adiabatic expansion, there is no collision among the molecules, which suggests that the molecules can be taken out as a molecular flow through the pore.

Equations (1) and (2) indicate that the shock wave dB in the first chamber and the position Xm, where the Mach disc is produced, are dependent on the first pore d1 and the low-vacuum chamber pressure P1.

Inside the shock wave, namely within the jet, ions and other molecules are rapidly cooled and solvent molecules such as water and alcohol attach to the ions, thereby creating cluster ions. If mass spectrometry is performed while there are such cluster ions, a problem arises that information about the actual molecular amount of ions cannot be obtained.

In this case, generally a desolvation operation is necessary to eliminate the water or alcohol molecules that attached to the cluster ions.

However, the molecular flow that has been cooled by adiabatic expansion is adiabatically compressed in the Mach disc plane and rapidly heated. As a result, there is less collision between molecules within the spray jet region, so that the droplets cannot be efficiently vaporized. However, by minimizing this spray jet region, which is related to the pressure ratio between opposite ends of the first pore 41 and the size of the first pore 41, and by disposing the first pore 41 at such a position that the spray jet region becomes a free jet, the droplets can be automatically and efficiently vaporized and the desolvation of the cluster ions can be promoted.

Accordingly, by setting the position of an intermediate pore 51, which is disposed downstream of the first pore 41, such that the distance of the intermediate pore 51 from the first pore 41 is more than the position where the Mach disc plane Xm is formed as determined from equation (2), the desolvation function can be facilitated. This method does not require any special energy supplies and can be most easily achieved.

However, downstream of the Mach disc plane, the molecular flow becomes a free jet (dispersive), and there remains the possible problem that the amount of ions that are introduced into the intermediate pore 51 decreases. Thus, it is necessary to optimize the size and position of the pore and pressure (P1) based on the shape of the shock wave that is produced, so as to promote the desolvation of the ions and increase the amount of ions that are introduced into the intermediate pore 51.

After performing various experiments, it was learned that by making the size of the intermediate pore 51 approximately three or more times the size of the first pore 41, the transmission ratio can be increased by increasing size of the intermediate pore 51. This is due to the fact that, as shown by equation (1), the magnitude dB (Mach disc size) of the jet produced in the pressure chamber of the first chamber 50 is 2.4 to 4.6 times the value of d1 even when the pressure varies, so that the ion transmission ratio is improved by setting the size of the intermediate pore 51 larger in a corresponding manner.

The position Xm of the Mach disc plane produced in the first chamber 50, namely the distance between the first pore 41 and the Mach disc plane, becomes shorter as pressure in the first chamber 50 increases, in accordance with equation (2). Thus, the position Xm of the Mach disc plane produced in the first chamber 50 is shorter when the pressure P1 in the first chamber 50 is relatively high. On the other hand, when the pressure is lower, Xm assumes a far larger value, such that the dispersion of the molecular flow downstream of the Mach disc plane becomes more prominent and the amount of ions introduced into the intermediate pore 51 decreases.

Further, if the distance between the first pore 41 and the intermediate pore 51 is large, the motion energy of ions tends to be more easily consumed due to collision with a neutral gas, resulting in a difficulty of the ions reaching the intermediate pore 51 and an increased pressure-dependency of the low-vacuum chamber.

Thus, by setting the distance between the intermediate pore 51 and the first pore 41 to be equal to or more than Xm, which is determined from equation (2), and equal to or less than 20 to 40 times the size of the first pore 41, the dependency of the ion transmission ratio on the pressure inside the first chamber 50 or the position where the Mach disc plane is produced can be reduced, so that a high and stable ion transmission ratio can be obtained.

While the above-described method of construction may be sequentially applied to each chamber in the differential exhaust chambers. However, since the pressure is gradually decreased, the size of opening increases, thereby requiring increasingly greater exhaustion capacity of the pump that is provided, which is disadvantageous.

The pressure in the mass spectrometric section must be on the order of $1\times10^{-6}$ to $1\times10^{-4}$ Torr. In such a range of pressure, ions have superior directional characteristics and can be obtained as a molecular flow whose trajectory can be easily controlled by an electric field.

Thus, in accordance with the method of the invention, ions are obtained as an ion beam flow (jet flow) sequentially up to the final-stage chamber (second chamber 60) of the differential exhaust chamber while being converged with the help of an electric field, and a molecular flow of ions is ejected from the opening size into the mass spectrometric section. In this method, the pressure at the final stage of the differential exhaust chamber and the size of ejection must be determined. They can be roughly determined from equation (4).

Equation (4) shows that di is ϕ0.2 to 1.5 mm at maximum due to the practical exhaustion capability of the pump and the pressure in the mass spectrometric section. Therefore, the boundary pressure of the nozzle beam and the molecular flow in the aforementioned diameter range is approximately 0.25 to 0.03 Torr, by analogy with equation (3). These values are the set pressure value for the final-stage chamber of the differential exhaust chamber. By sequentially determining the diameter of the Mach disc (dB) and its position with respect to the pressure (1 Torr to 50 Torr) in the initial stage of the differential exhaust chamber, it is possible to obtain such a structure of the differential exhaust chamber that the amount of ion transmission is not reduced.

As a result of various experiments and calculations with regard to the aforementioned set parameters, it was learned that the cluster ions can be eliminated and a high ion transmission amount can be obtained by: dividing the differential exhaust chamber into at least two chambers, namely one at the atmospheric pressure ion source (initial-stage portion) side and the other at the mass spectrometric section (final-stage portion) side; setting the pressure in the initial portion of the differential exhaust chamber to be at 1 to 50 Torr; setting the pressure in the final-stage portion to be at 0.25 to 0.03 Torr; and setting the pressure attenuation ratio between the differential exhaust chambers to be at 1/10 to 1/100.

FIG. 1 shows the structure of the differential exhaust section made up of two chambers based on the above indications. FIG. 2B schematically and exclusively shows the behavior (flow-line trajectory) of the fluid.

In this configuration, by setting the pressure in the first chamber 50 at approximately 3 to 5 Torr and the pressure attenuation ratio of the second chamber 60 at approximately 1/10, ions were obtained as a converged ion beam stream of about ϕ0.2 to 0.6. The ion beam is ejected from a skimmer 811 and then becomes a molecular stream in the mass spectrometric chamber 80.

The ion beam stream, while it behaves in a viscous stream-like manner at high pressure, comes to have an increasingly longer mean free path with decreasing pressure. If an electric field is then produced in such a direction as to accelerate the ions, the ions are accelerated and fly in the electric field and repeatedly collide with the neutral molecules. These collisions cause water molecules to be removed. The convergence characteristics of the ions are also improved as the pressure decreases, as they are in the aforementioned ionization section.

Accordingly, in order to generate an ion acceleration electric field for a first pore body 4, an intermediate pore body 5, and a second pore body that form the individual chambers of the differential exhaust chamber, a voltage is applied to each pore body from a drift power supply generating portion 130. When the ions are positive, voltages are applied such that first pore body 4>intermediate pore body 5>second pore body 6. When the ions are negative, voltages are applied such that first pore body 4<intermediate pore body 5<second pore body 6.

While the convergence characteristics (or the transmission amount) of ions can be improved in the above-described configuration, the present invention separately employs a first converging electrode 7 in the first chamber 50 (between first pore 41 and intermediate pore 51), in order to improve the ion convergence characteristics.

Figure 2A:
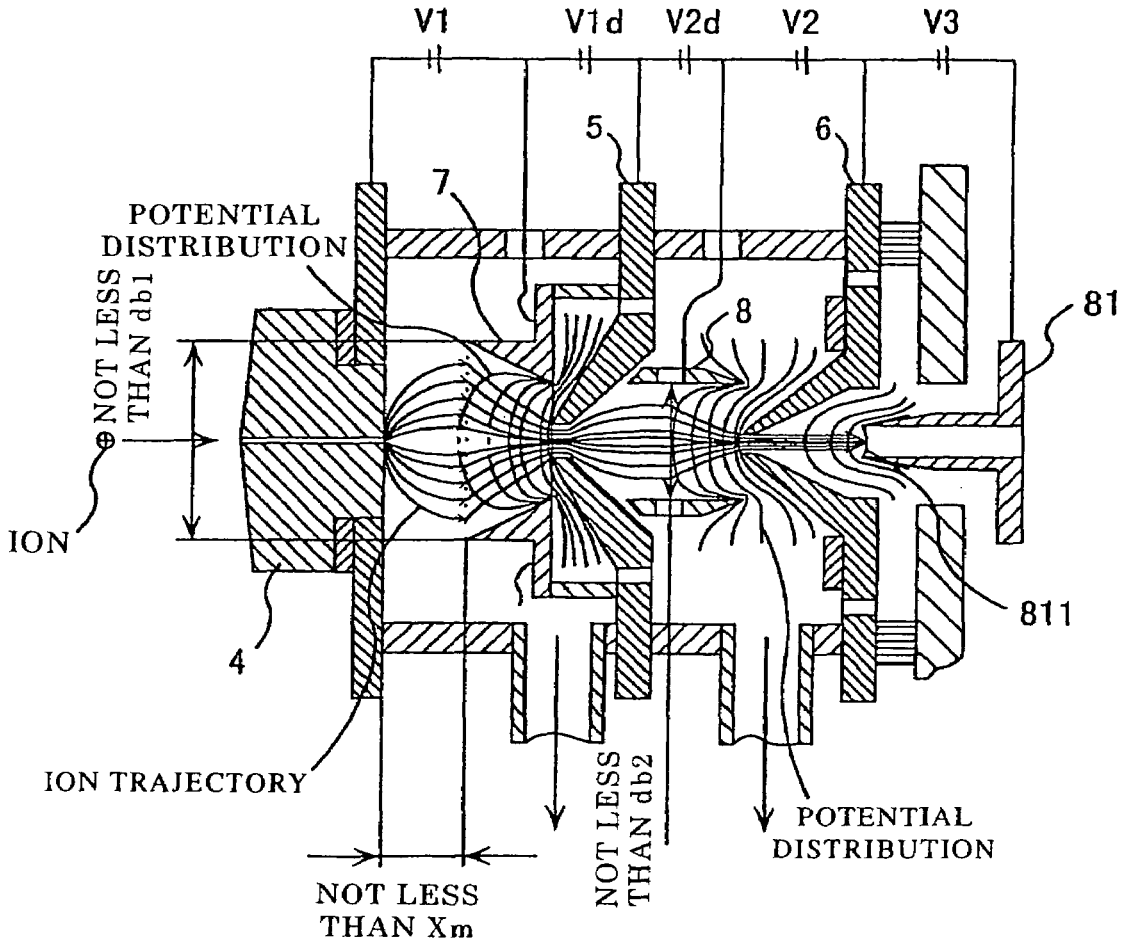
FIG. 2A shows the structure of an interface section (differential exhaust chamber) equipped with a converging electrode, and its potential line distribution and flow line distribution.
Figure 2B:
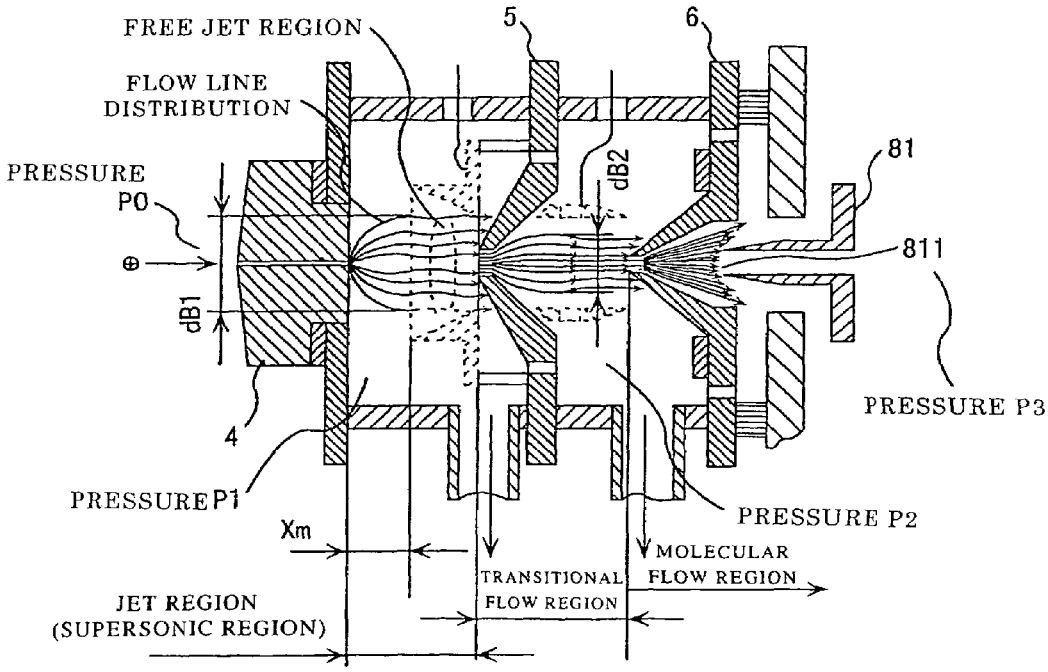
FIG. 2B shows the interface section (differential exhaust chamber) not equipped with a converging electrode, and its potential line distribution and flow line distribution.

Specifically, as shown in FIG. 2A, the first converging electrode 7 has its one open-end portion (entry portion) disposed opposite the first pore 41 and the other open-end portion (exit portion) disposed near the intermediate pore 51. As mentioned above, the position of the open-end portion of the first converging electrode 7 towards the entry portion has an interval that is not less than the position (Xm) of the Mach disc plane, which is determined by the diameter d1 of the first pore and the pressure inside the first chamber 50, and the diameter of the open-end portion is set to be not less than that of the Mach disc (dB). The open-end portion towards the exit portion is disposed near the intermediate pore 51, and its diameter is set to be not less than that of the intermediate pore 51 (dc) and smaller than that of the open-end portion towards the entry side. Namely, the first converging electrode 7 is formed such that it tapers from the first pore 41.

As the first converging electrode 7 is formed as described above, the ion jet ejected from the first pore 41 does not come into contact with the first converging electrode 7, and, after desolvation, the ion jet becomes a free jet (whereby the Mach disc plane Xm is formed).

FIG. 2B schematically shows the trajectory of the jet in a case that the first converging electrode 7 has been removed and the potentials V1 and V1d are equal. In this case, the ion transmission ratio is determined by the ratio of the Mach disc diameter dB to the intermediate pore diameter dc (dc/dB), so that the majority of the ions is absorbed by the intermediate pore body 5.

However, in the configuration of FIG. 2A, the potential distribution between the first converging electrode 7 and the intermediate pore body 5 exhibits such a distribution shape as the cone shape of the intermediate pore 51 is transferred, such that the end portion of the cone can be extended to the position where the ion jet from the first pore 41 produces the Mach disc plane (Xm). Thus, the ions that have been turned into a free jet are sequentially accelerated in a direction (electric field) normal to the potential line shape and are converged towards the intermediate pore 51, such that the convergence characteristics are significantly improved.

Further, by making the inside of the first converging electrode 7 tapered and forming its end in an acute angle, as shown, a greater potential line drop (gradient) than that produced by the intermediate pore 51 can be given, such that the length of the cone of the intermediate pore 51 can be reduced.

The acceleration potential that is added is V1d>V1, where V1 may be several volts or equal to the potential of the first pore body 43. This is due to the fact that the ion accelerating energy at the jet portion is based on fluid force rather than electric field. Therefore, the potential of several volts at maximum is sufficient. An insulating spacer 72 provided between the intermediate pore body 5 and the first converging electrode 7 is for electric insulation.

The measured ions that have passed through the intermediate pore 51 are then introduced into the second chamber 60. The pressure in the second chamber is set to be smaller than that in the first chamber 50, as mentioned above, so that the free path is increased in length. This region is a transitional flow region which is neither a molecular flow region nor a fluid region. Thus, there arises a mixed condition of a jet state similar to that in the first chamber 50 and a foam state that is seen in a molecular flow region. However, due to the increased length of the free path, as mentioned above, an advantage can be obtained that the trajectory can be easily corrected or adjusted by electric field. Thus, the second pore 61 is formed such that it is opposite the intermediate pore 51 and it's cone shape is more acute than the cone of the first pore 51, as shown in FIG. 2A, thereby improving its convergence characteristics.

In order to improve the convergence characteristics further, the shape of the cone should be made as sharp as possible and the cone should be placed as close to the intermediate pore 51 as possible. However, it causes the pressure at the relevant portion to be unstable due to pressure variation in the first chamber 50. Further, there is the possibility that an electric discharge is produced between the intermediate pore body 5 and the second pore body 6, which would extremely destabilize the equipment. Thus, in the present invention, a second converging electrode 8 is provided in the second chamber 60 to improve the convergence characteristics and to eliminate destabilizing factors such as discharge and pressure variations.

Specifically, as shown in FIGS. 1 and 2A, the second converging electrode 8, which is formed as a pipe, is disposed in the second chamber 60. The end of the second converging electrode 8 opposite the second pore 61 is formed with an acute angle, and the acute end portion is disposed over the circumference of the second pore 61. The diameter of the second converging electrode is at least not less than the diameter (d2) of the second pore 61, and is not less than the Mach disc diameter (dB2), which is determined by the pressure in the first chamber 50 and second chamber 60. The length of the second converging electrode 8 is not less than the position where the Mach disc plane (Xm) is formed.

In this configuration, the potential line distribution between the second converging electrode 8 and the intermediate pore body 5 exhibits such a distribution shape as the cone shape of the second pore 61 is transferred, such that the end portion of the cone can be extended to the position where the Mach disc plane (Xm) is formed. Thus, the ions in the form of a transitional jet are successively accelerated in a direction normal to the contour of the potential lines (electric field), and the end of the jet is located at the second pore 61, such that the convergence characteristics are improved. Further, as shown, the end portion of the second converging electrode 8 is formed with an acute angle thereby giving a greater potential line drop (gradient) than the cone shape of the intermediate pore 51, so that the gradient is increased. The acceleration voltage that is added is such that V1d>V2d>V2, where V1d and V2d may be equal. This is due to the fact that at the transitional flow portion, the ion acceleration energy is based on electric field rather than fluid force. Thus, the degree of convergence can be determined by the electric field distribution between the second converging electrode 8 and the second pore 61.

Further, the first pore 41, first converging electrode 7, and intermediate pore 51 are positioned to share a common axis, and the second converging electrode 8, second pore 61, converging electrode 8, and skimmer 811 are positioned to share a common axis. As a result, a more stable and higher ion transmission ratio can be obtained and the desolvation of neutral molecules and droplets is promoted, thereby improving the vaporization efficiency of droplets.

By providing the first pore body 4 and the second pore body 6 with a heater 42 and a heater 63 respectively to increase each portion, the desolvation of the neutral molecules and droplets can be promoted, resulting in a more efficient vaporization.

While the structure of the differential exhaust chamber has been described in detail, there is no change to the function of improving the transmission ratio and simultaneously desolvation whether the substance is measured by positive ionization or negative ionization. In actual measurement, the polarity of the needle electrode may be reversed by means of the HV power supply 110 shown in FIG. 1, and simultaneously the polarity of the acceleration potential in the above-described differential exhaust chamber may be reversed. Alternatively, a needle power supply generating portion 120 and a drift power supply generating portion 130 may be switched alternately or at predetermined periods between a positive ion mode and a negative ion mode in measurement.

The exhaust pump provided in the differential exhaust section may be a rotary pump, a scroll pump, a mechanical booster pump, or a turbo-molecular pump, for example. In the embodiment shown in FIG. 1, the first chamber 50, second chamber 60, and mass spectrometric section 80 are independently exhausted. For the exhaustion of the first chamber 50, a scroll pump 210 (with a displacement of approximately 300 to 900 L/min) is used. For the second chamber 60 and the mass spectrometric section 80, a split-flow type turbo-molecular pump 220 (with a displacement of approximately 150 to 300 L/s) is used. The back pressure of the turbo-molecular pump 220 is provided by the scroll pump 210 via a connecting pipe 76. Openings 52 and 62 provided in the intermediate pore body 5 and the second pore body 6 are for setting and adjusting pressure in a hardware manner.

In this configuration, a predetermined target pressure value can be easily set by determining the conductance of each chamber that corresponds to the exhaustion capability of the pump that is applied. As the split-flow type turbo molecular pump is a single component exhaust pump, the split-flow type turbo molecular pump is effective in terms of package space volume and economy, for example.

The ions that flew out from the final stage of the differential exhaust chamber into the molecular flow region are converged initially by the skimmer 81 disposed at the entry to the mass spectrometric section 80 and then converged by a converging lens assembly, which uses an Einzel lens that normally consists of three lens electrodes (converging lens electrodes 82, 83, 84).

The ions that have passed through the skimmer opening 811 provided in the skimmer 81 pass through the converging lens electrodes 82, 83, and 84 equipped with slits and are thereby converged. Neutrons, which are not converged, collide with the slit of the converging lens electrode 84 and are prevented from reaching the mass spectrometric section.

The ions that have passed through the converging lens electrode 84 are polarized and converged by a bi-cylindrical polarizer consisting of an internal cylindrical electrode 86 having many openings and an external cylindrical electrode 85. In the bi-cylindrical polarizer, the ions are deflected and converged by an electric field of the external cylindrical electrode 85 seeping through the openings of the internal cylindrical electrode 86.

The ions that have passed through the bi-cylindrical polarizer are introduced into an ion-trapping mass spectrometric section. The ion-trapping mass spectrometric section comprises a gate electrode 91*a*, end-cap electrode 92, ring electrode 94, collar electrode 921, insulating ring 93, and ion-takeout lens 91*b*.

The gate electrode 91 serves to prevent the ions from being introduced into the mass spectrometric section from outside when the ions captured inside the ion-trapping mass spectrometric section are taken out from the ion-trapping mass spectrometric section.

The ions introduced into the ion-trapping mass spectrometric section through a pore 92*a* in the end-cap electrode 92 collide with a buffer gas such as helium that is introduced into the ion-trapping mass spectrometric section causing the trajectory of the ions to be smaller. Thereafter, the ions are scanned by a high-frequency voltage applied between the end-cap electrode 92 and the ring electrode 94. As a result, the ions are discharged out from the ion-trapping mass spectrometric section on a mass-number basis through a pore 92*b* in the end-cap electrode 92. The ions are then passed through the ion-takeout lens 91*b* and detected by ion detectors 101 and 102. The aforementioned buffer gas is continuously supplied from an external cylinder of He gas, for example, via a back gas supply pipe 103. The pressure inside the ion-trapping mass spectrometric section when the buffer gas is introduced is on the order of $10^{-3}$ to $10^{-4}$ Torr.

Figure 2C:
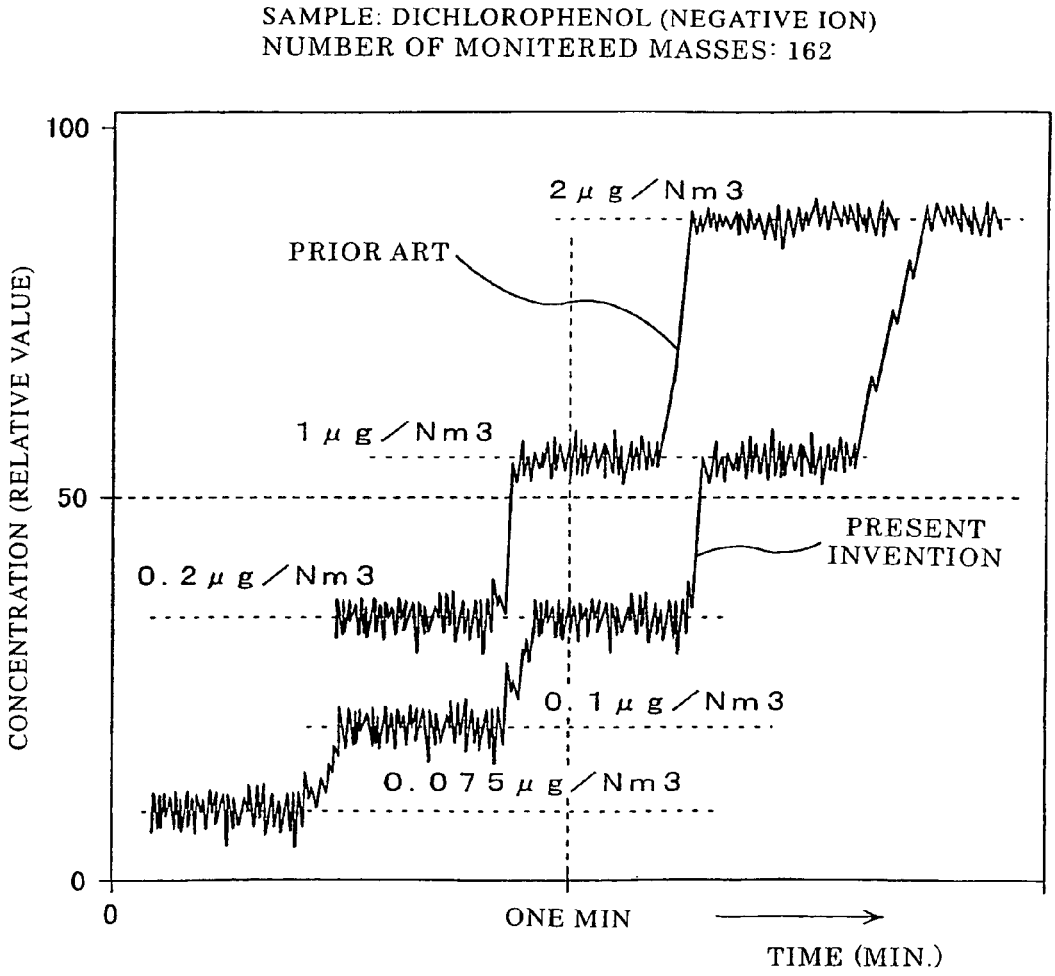
FIG. 2C shows a graph in which examples of outputs according to the present invention and according to the prior art are plotted.

FIG. 2C shows signal intensities of the present invention and the prior art. Measurement conditions were identical, and the sample was prepared by adding dichlorophenol in solvent to dissolution. In the figure, the vertical axis indicates the relative ion intensity normalized by relative ion intensity, and the horizontal axis indicates time. As shown, the signal intensity of dichlorophenol (negative ion) is clearly measured at lower concentrations with a high S/N ratio. This is due to the fact that in the present invention, the ion transmission ratio is high and desolvation is performed sufficiently.

The ion-trapping mass spectrometric section is controlled by a mass spectrometric section control portion (not shown).

One of the merits of the ion trapping mass spectrometer is that as it characteristically captures ions, ions can be detected even when the sample concentration is low by extending the duration of storage. Thus, even when the sample concentration is low, ions can be enriched in the ion-trapping mass spectrometric section at high ratios, so that sample preprocessing, such as enrichment, can be very much simplified.

Figure 3:
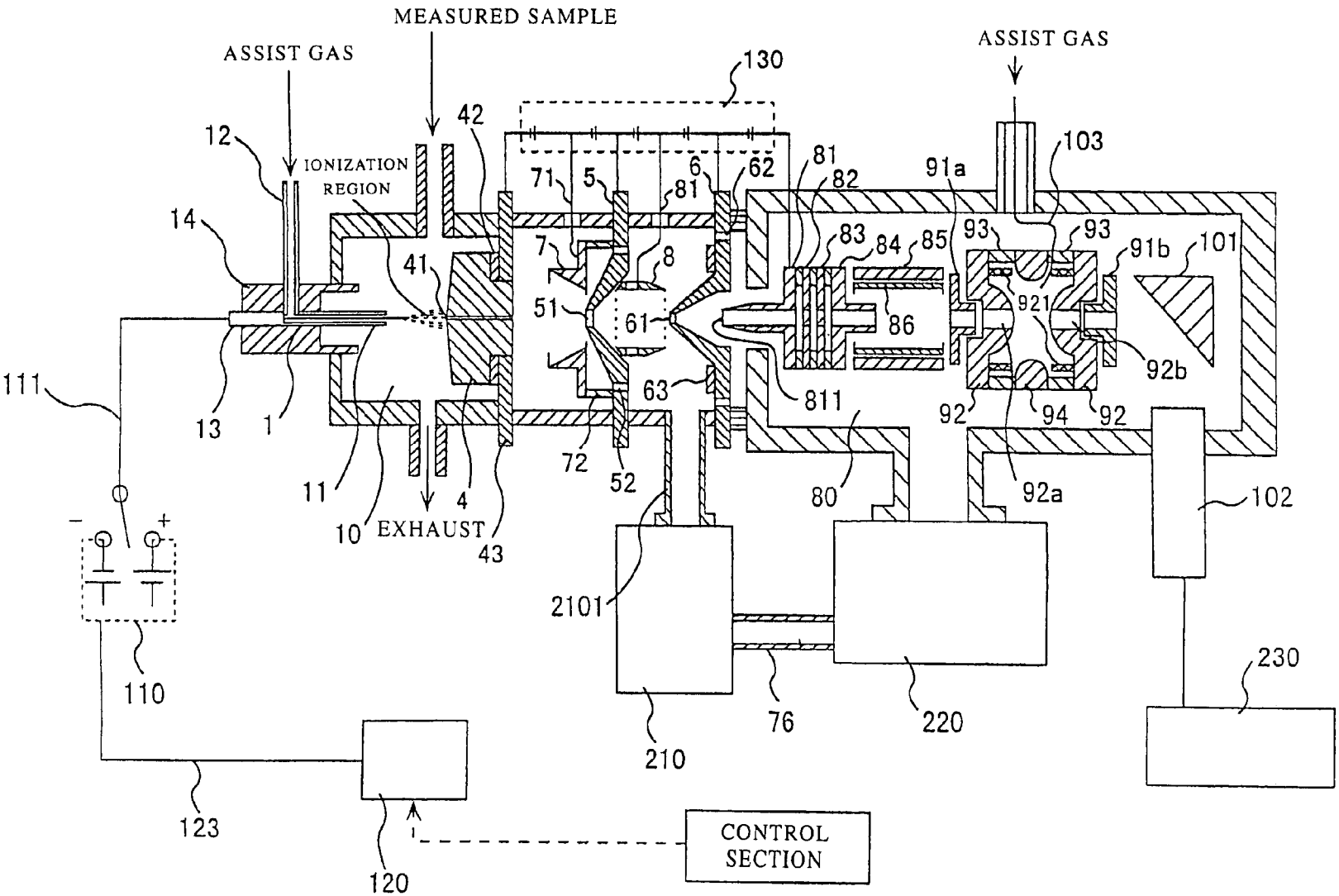
FIG. 3 is an overall view of another embodiment of the invention.

FIG. 3 shows another embodiment of the invention.

This embodiment differs from the embodiment of FIG. 1 in that the exhaust pump 210, which has been used for exhausting the first chamber 50 in the earlier embodiment, is directly connected to the second chamber 60. In this case too, the pressure in the first chamber 50 can be easily set to a predetermined value by adjusting the conductance via the openings 52 provided in the intermediate pore body 5. Thus, there is no reduction in the ion transmission ratio, nor is there any change in the desolvation function. The present embodiment can therefore provide the advantage of better economy.

Figure 4:
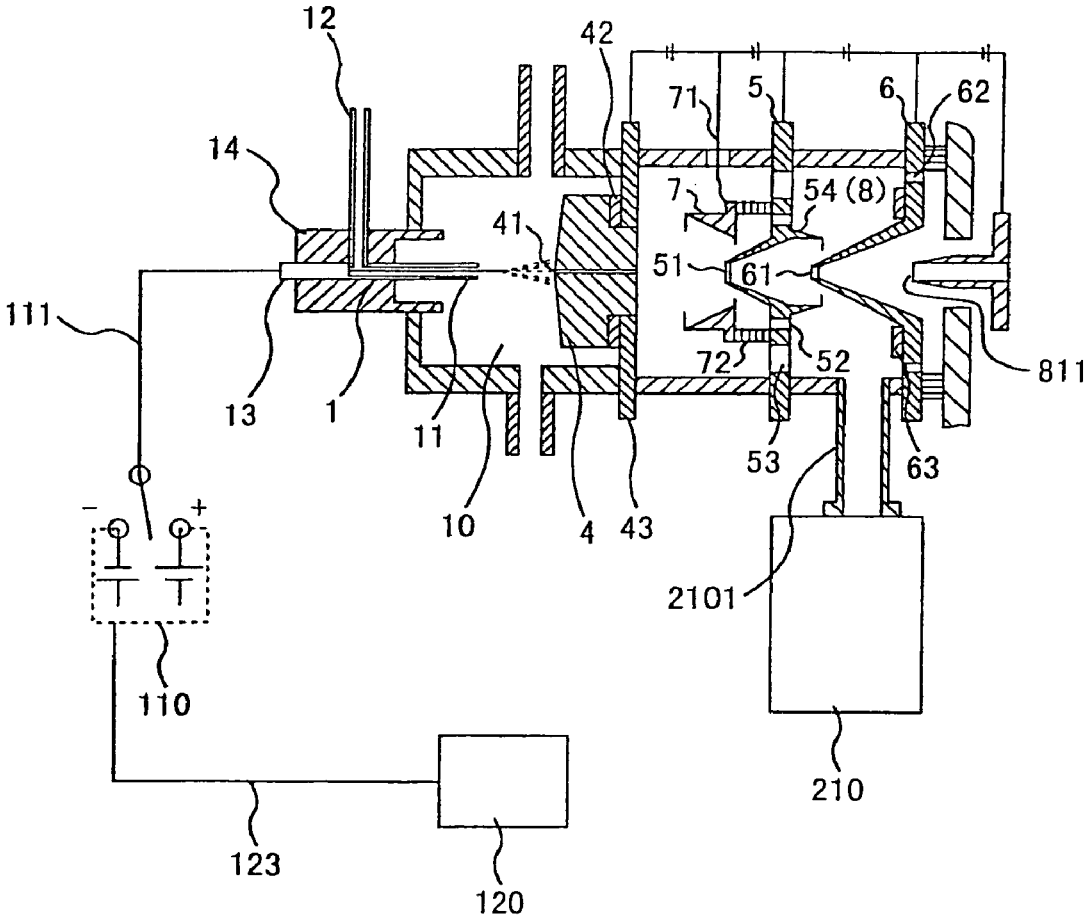
FIG. 4 is an overall view of another embodiment of the invention.
Figure 5:
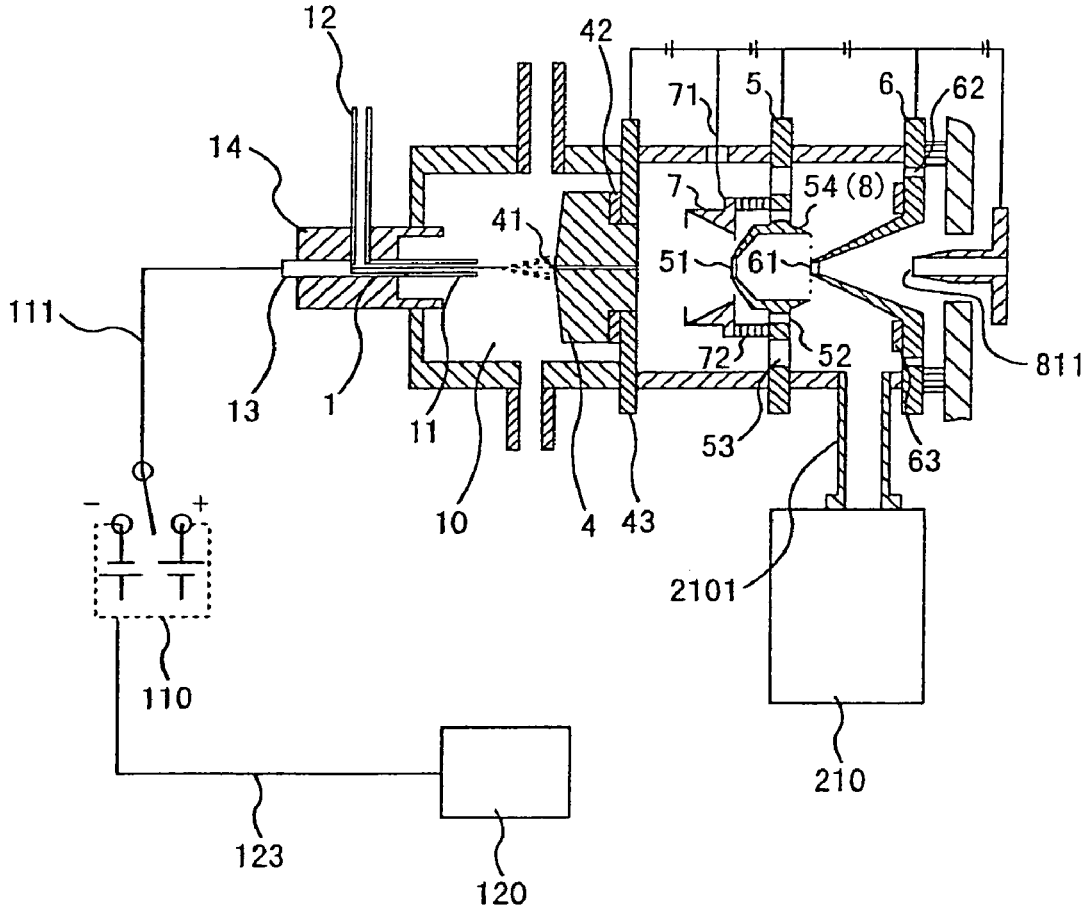
FIG. 5 is an overall view of another embodiment of the invention.

FIGS. 4 and 5 show other embodiments of the invention.

These embodiments differ from the embodiment of FIG. 1 in that the end portion of the first converging electrode 7 of the first chamber 50 is overlapped with the tip of the cone of the intermediate pore 51, such that the tip of the intermediate pore 51 is extending into the entry to the first converging electrode 7.

Further, the second converging electrode 8 equipped in the second chamber 60 is eliminated, and a cylindrical projection 54 with a sharp end is integrally formed in the intermediate pore body 5 towards the second chamber 60.

Further, the end of the cylindrical projection is disposed more towards the skimmer 81 than the second pore 61.

While the exhaustion mechanism for each chamber is the same for that of the embodiment of FIG. 3, the single exhaustion mechanism shown in FIG. 1 may be used.

In that case, there is no reduction in the ion transmission ratio or the desolvation function; in fact, as the number of parts can be reduced, higher equipment reliability and better economy can be obtained. As the tip of the cone of the intermediate pore 51 is overlapped in the jet region of the first chamber 50, and further the second pore 61 is positioned inside the cylindrical projection 54 with the sharp edge in the transitional flow region of the second chamber 60, the potential line gradient can be increased. As a result, the convergence characteristics can be made more stable and the transmission ratio can be improved. Further, a conductance opening 53 may be newly added to the intermediate pore body 5 for pressure adjustment purposes, whereby the pressure in the first chamber can be made more stable.

Alternatively, the end of the first converging electrode 7 towards the intermediate pore 51 and the tip of the intermediate pore 51 may be made to coincide, and the end of the cylindrical projection 54 may be made to coincide with the tip of the second pore 61, as shown in FIG. 5. In this configuration, too, the potential line gradient can be increased and more stable convergence characteristics can be ensured, resulting in an improved transmission ratio.

Figure 6:
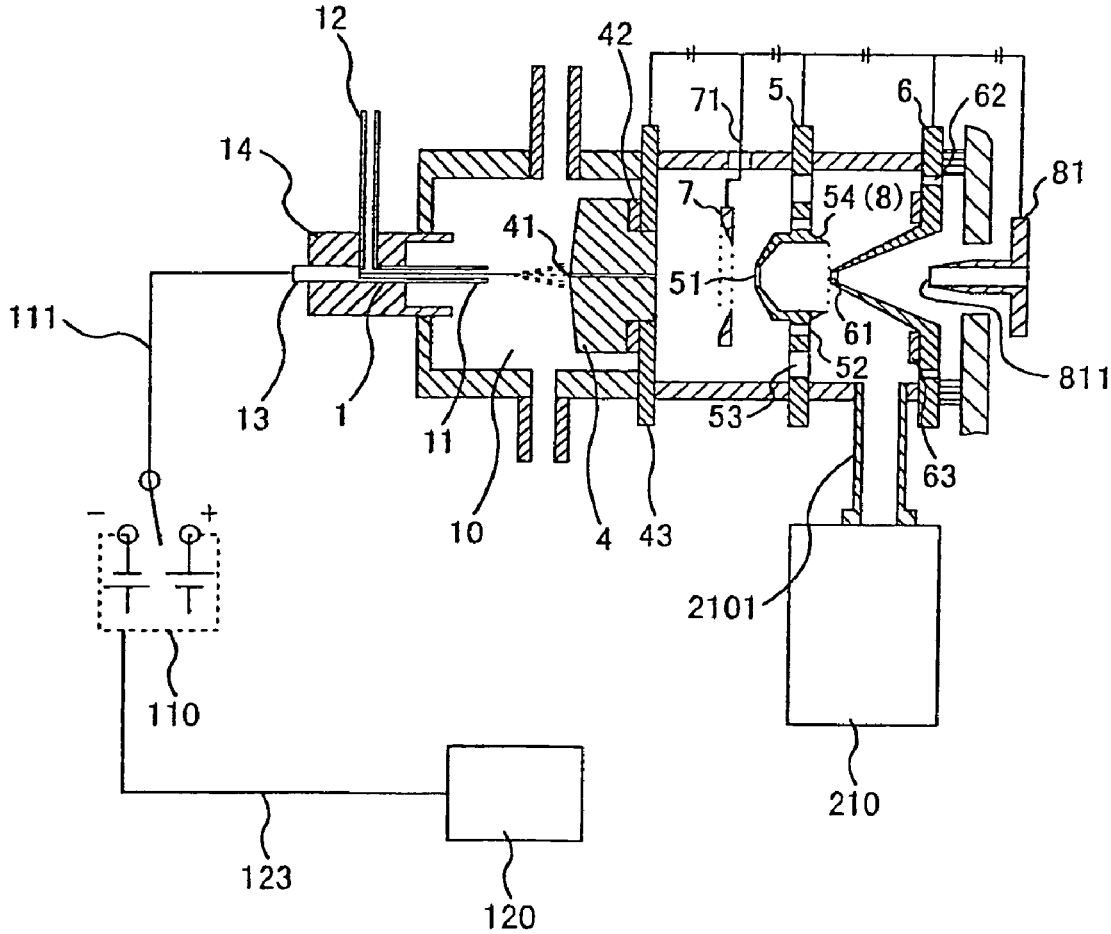
FIG. 6 is an overall view of another embodiment of the invention.
Figure 7:
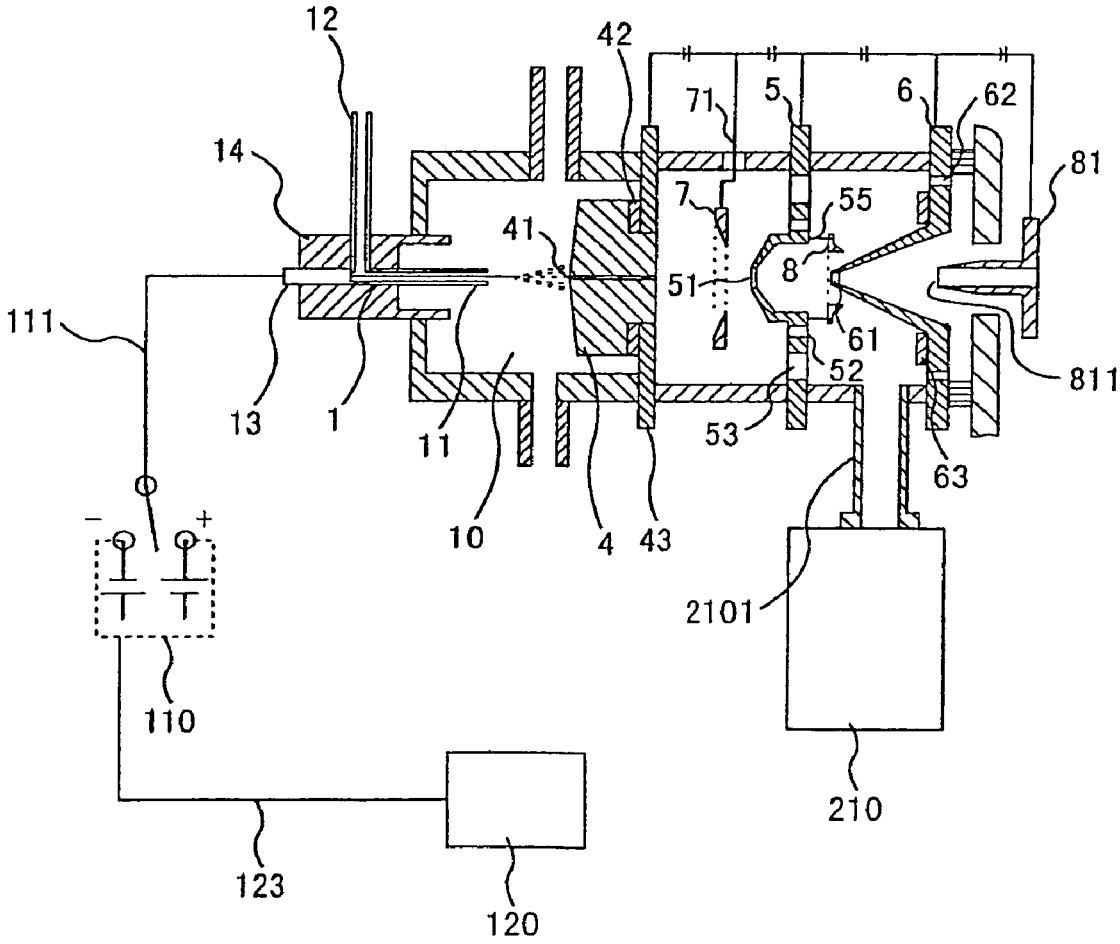
FIG. 7 is an overall view of another embodiment of the invention.

FIGS. 6 and 7 show other embodiments of the invention. These embodiments differ from the embodiment of FIG. 1 in the shape and position of the first converging electrode 7 provided in the first chamber 50, and in that the insulating spacer 72 for ensuring the insulation from the intermediate pore body 5 is eliminated. In the present embodiments, the first converging electrode 7 is formed by a thin disc with its inside formed as a knife edge, as shown. The first converging electrode 7 is disposed away from the tip of the intermediate pore 51.

Further, the second converging electrode 8 is eliminated from the second chamber 60, and the cylindrical projection 54 with a sharp end is integrally formed in the intermediate pore body 5 towards the second chamber 60. The end of the sharp cylindrical projection 54 is made to coincide with the tip of the second pore 61. While the exhaustion mechanism for each chamber is the same as that of the embodiment of FIG. 3, the single exhaustion mechanism shown in FIG. 1 may be employed.

In this configuration, there is no reduction in the ion transmission ratio or the desolvation function; in fact, as the first converging electrode 7 can be manufactured at less cost and the number of parts would be reduced, an improved equipment reliability can be obtained and the spatial volume of the first chamber 50 can be increased. As a result, the pressure inside the first chamber can be stabilized more and better economy can be obtained.

Alternatively, as shown in FIG. 7, the cylindrical projection 54 may be separated, and the separated cylindrical projection 54 may be connected to the intermediate pore body 5 via a conductive connector 55 to equalize the potentials. In this case, although the advantage resulting from the integration of parts can not be obtained, the cylindrical projection can be handled as an independent component which can be maintained more easily.

Figure 8:
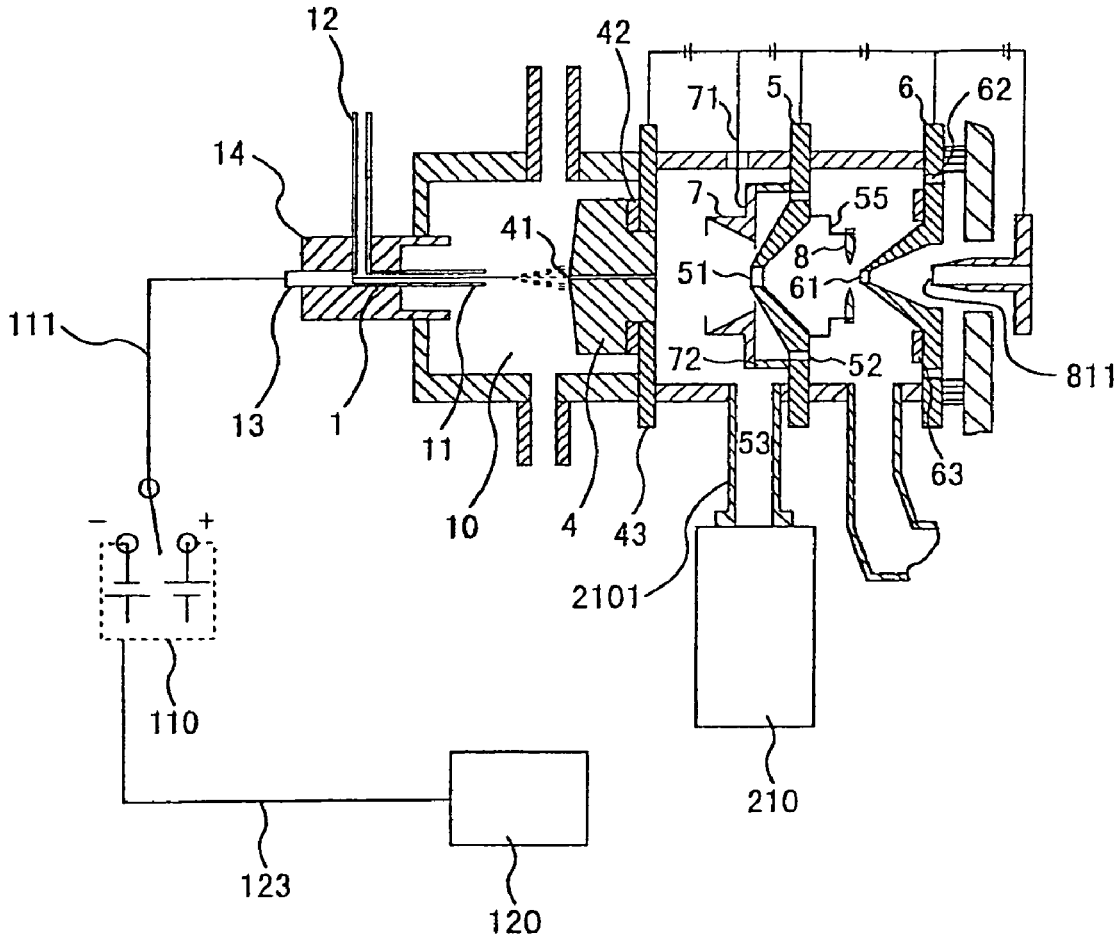
FIG. 8 is an overall view of another embodiment of the invention.

FIG. 8 shows another embodiment of the invention.

The embodiment differs from that of FIG. 1 in the shape and position of the second converging electrode 8 provided in the second chamber 60. In the present embodiment, the second converging electrode 8 is formed by a thin disc with its inside formed as a knife edge, as shown. The second converging electrode is disposed away from the tip of the second pore 61.

Further, as shown, the second converging electrode 8 and the intermediate pore body 5 may be connected by a conductive connector 55 so as to equalize the potentials.

Although the exhaustion mechanism for each chamber is the same as that of the embodiment of FIG. 1, the exhaustion mechanism shown in FIG. 3 may be used.

In this configuration, there is no reduction in the ion transmission ratio or the desolvation function; in fact, the second converging electrode 8 can be manufactured at less cost and better economy can be obtained. Further, the second converging electrode 8 can be handled as a separate component which can be maintained more easily. As the spatial volume in the second chamber 60 can be increased, the pressure in the second chamber can be made more stable.

Figure 9:
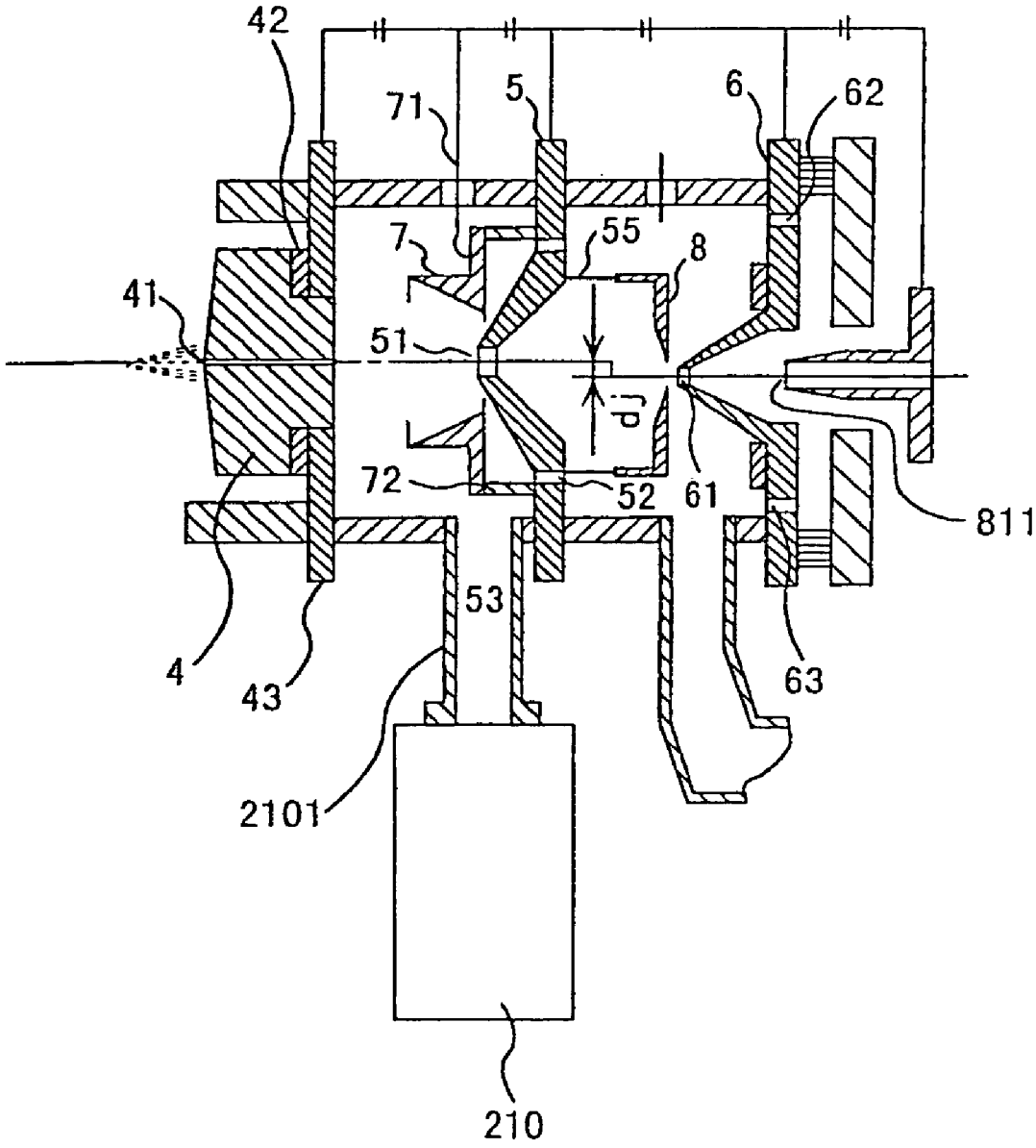
FIG. 9 is an overall view of another embodiment of the invention.

FIG. 9 shows yet another embodiment of the invention.

In the above embodiments, the flow channels for the jet, transitional flow, and molecular flow inside the differential exhaust chamber are formed by linear flow channels. Namely, the first pore 41, first converging electrode 7, intermediate pore 51, second converging electrode 8, second pore 61, and skimmer 81 have a common axis such that they make up a linear flow channel.

Meanwhile, if the separation and extraction in the preprocessing section are insufficient, the amount of the measured substance to be detected could be reduced to such an extent that the influence of neutral molecules becomes pronounced, noise components increase, and the S/N ratio becomes poor. In such a case, although the separation and extraction in the preprocessing step should preferably be repeated and measurements taken once again, that would be inefficient. Therefore, it is desirable to provide the measuring equipment with as much means as possible to deal with the aforementioned problem. The present embodiment is adapted to be able to cope with the problem.

Specifically, in the present embodiment, the first pore 41, first converging electrode 7 and intermediate pore 51, which are disposed in the first chamber 50 (jet mode), are positioned on a common axis (axis 1), as shown in FIG. 9, such that the ionized sample can be converged towards the intermediate pore 51 while performing a desolvation process. The neutral molecules contained in the jet travel substantially in parallel following the free jet and are blocked by the intermediate pore body 5, as shown in FIG. 9, so that the influence of the neutral molecules is reduced.

Then, the ion flow passes through the second chamber 60. The second converging electrode 8 and the second pore 61 in the second chamber 60 are positioned on an axis (axis 2) that is intentionally displaced from the axis (axis 1) of the first chamber 50 (with a displacement dj, as shown). As a result, the ion flow is blocked by the plane of the second converging electrode 8. On the other hand, the ionized measured molecules can be easily bent by an electric field, as described in the above embodiments, and they can also be converged towards the second pore 61. As a result, the generation of noise due to neutral molecules can be reduced, thereby allowing a signal with high S/N to be obtained even when the measured amount is extremely small. Further, the second converging electrode 8 and the intermediate pore body 5 may be connected by the conductive connector 55 so as to equalize the potentials.

While the exhaustion mechanism for each chamber is the same as that of the embodiment shown in FIG. 1, the exhaustion mechanism shown in FIG. 3 may be employed. With regard to the structures of each converging electrode and the intermediate pore body provided in the first chamber 50 and the second chamber 60, any of the structures employed in the above embodiments (FIGS. 1, 3 to 8) may evidently be employed.

Figure 10:
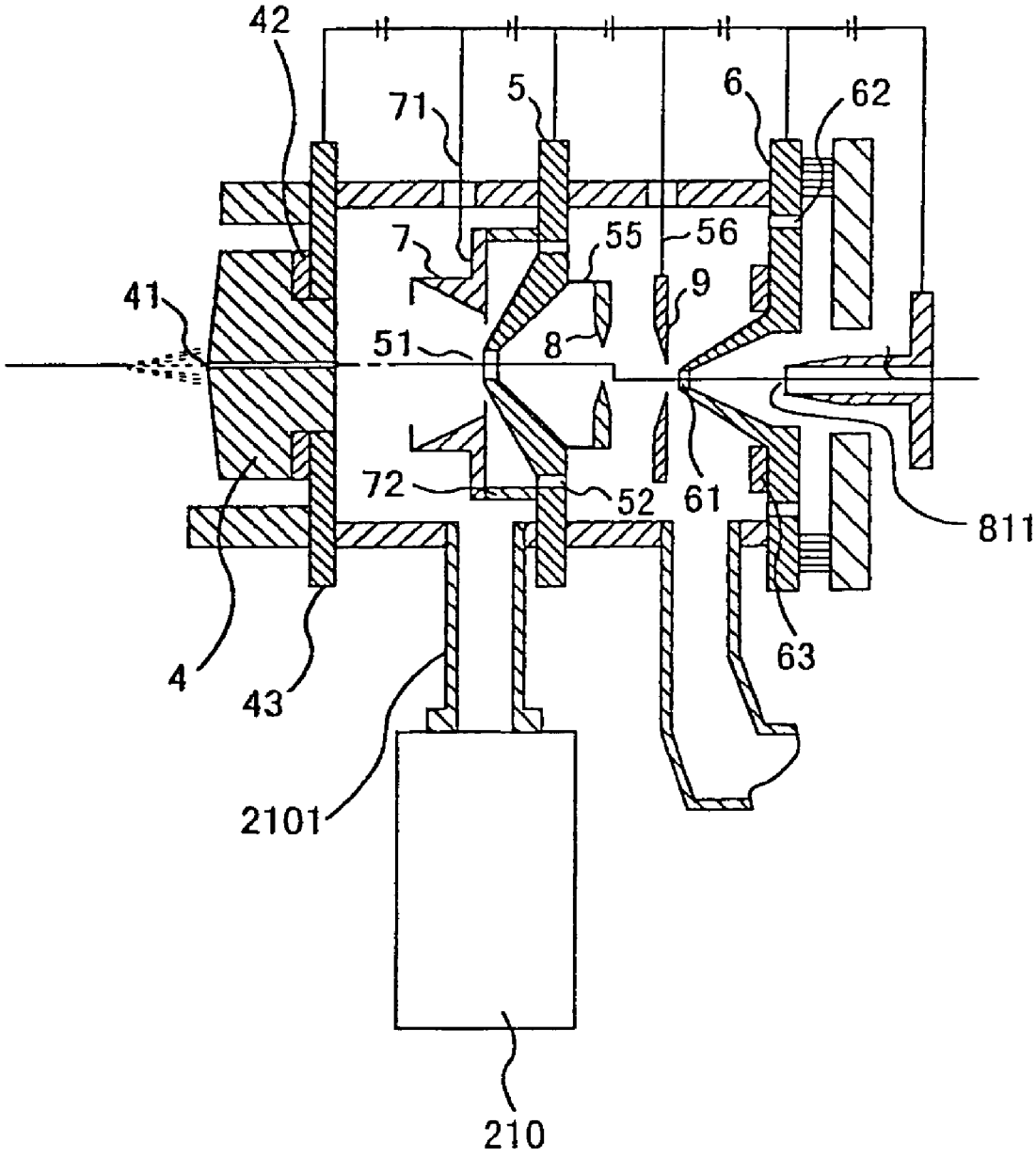
FIG. 10 is an overall view of another embodiment of the invention.

FIG. 10 shows a further embodiment of the invention.

The present embodiment differs from the embodiment of FIG. 9 in that there is provided a third converging electrode 9 in the second chamber 60. The third converging electrode 9 is formed by a thin disc with its inside formed as a knife edge, as shown. The third converging electrode 9 is disposed between the second converging electrode 8 and the second pore 61, near the tip of the latter. A voltage is supplied to the third converging electrode 9 via a conductive connector 56. The potential relationships are as follows. In the case of positive ions, potentials are intermediate pore body 5 (first converging electrode 8)>third converging electrode 9>second pore body 6. In the case of negative ions, potentials are intermediate pore body 5 (first converging electrode 8)<third converging electrode 9<second pore body 6.

In this configuration, the ion flow in the transitional flow region that has entered into the second chamber 60 is converged by the intermediate pore 5 and the electric field of the second converging electrode 8. The ion flow is then further converged by the third converging electrode 9. Because the axis (axis 2) of the third converging electrode 9 and the second pore 61 is eccentric with respect to the axis (axis 1) of the first chamber 50, the neutral molecules that remain in the measured body are blocked by the plane of the third converging electrode 9. On the other hand, the ionized measured molecules can be easily bent by an electric field, as mentioned in the above embodiments and can be converged towards the second pore 61.

As a result, the generation of noise by neutral molecules can be reduced even more, and a signal with a high S/N can be obtained even when the measured amount is extremely small.

Alternatively, the third converging electrode 9 and the second pore body 6 may be connected by a conductive connector so as to equalize the potentials.

While the exhaustion mechanism for each chamber is the same as that of the embodiment of FIG. 1, the exhaustion mechanism shown in FIG. 3 may be employed. With regard to the structures of each converging electrode and the intermediate pore body provided in the first chamber 50 and the second chamber 60, any of the structures employed in the above embodiments (FIGS. 1, 3 to 9) may evidently be employed.

Figure 11:
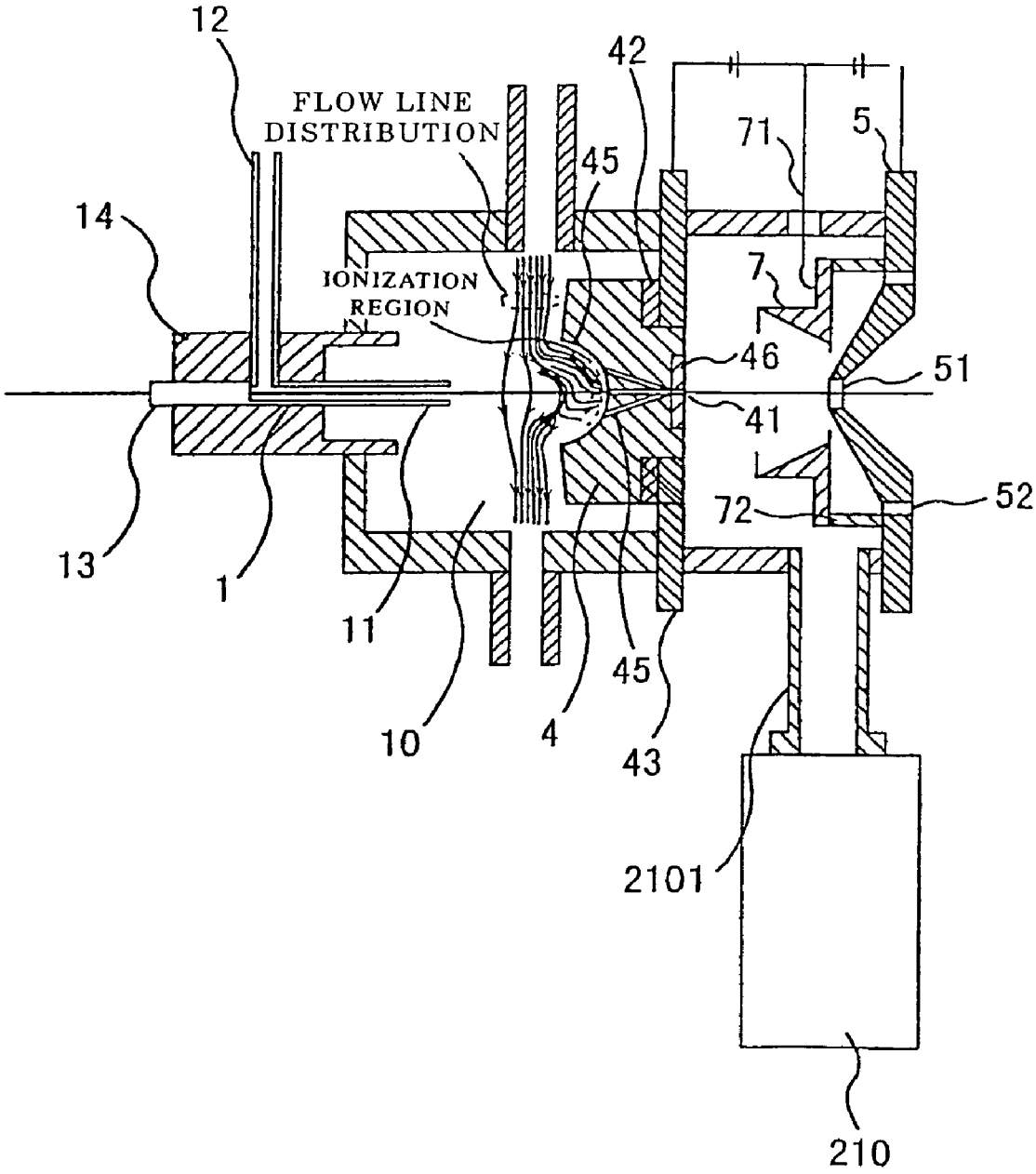
FIG. 11 is a cross section of the interface section (differential exhaust chamber) of another embodiment of the invention.

FIG. 11 shows another embodiment of the invention.

The present embodiment differs from the embodiment of FIG. 1 in the structure of the first pore body 4 and the position where the sample is ionized. In the previous embodiments, a corona discharge is produced between the needle electrode 1 and the first pore body 4 so as to ionize the sample. In the present embodiment, as shown, a spherical concave surface 44 is provided in the first pore body 4, and the tip of the needle electrode 1 is positioned inside the spherical concave portion. Further, a plurality of pores m 45 are provided in the concave portion, and their ends are in communication with the first pore body 2 46. The diameter of the opening provided in the first pore body 2 46 is equal to d1, and is attached to the first pore body 4 in an air-tight manner.

In this configuration, the sample that has entered the ionization chamber 10 have their flow lines varied by the spherical concave portion, as shown and enters the spherical concave portion. At the tip of the needle electrode 1 and the spherical concave portion, there is a uniform corona discharge (the potential distribution is made uniform over an extended area due to the spherical shape). As a result, the sample that has flown in is ionized in this region. Simultaneously, the sample is taken into the multiple pores m 45 provided in the spherical concave plane due to the pressure gradient with respect to the first chamber 50, and is then ejected via the pore in the first pore body 2 46 into the first chamber 50.

In this configuration, the ion transmission ratio and the desolvation function do not deteriorate; in fact, there can be obtained the advantage that the amount of ions taken into the differential exhaust chamber can be increased in a stable manner.

While the exhaustion mechanism for each chamber is the same as that for the embodiment of FIG. 1, the exhaustion mechanism shown in FIG. 3 may be used. For the structure of each converging electrode and the intermediate pore body provided in the first chamber 50 and the second chamber 60, any of the structures employed in the previous embodiments (FIGS. 1, 3 to 11) may obviously be employed.

Figure 12:
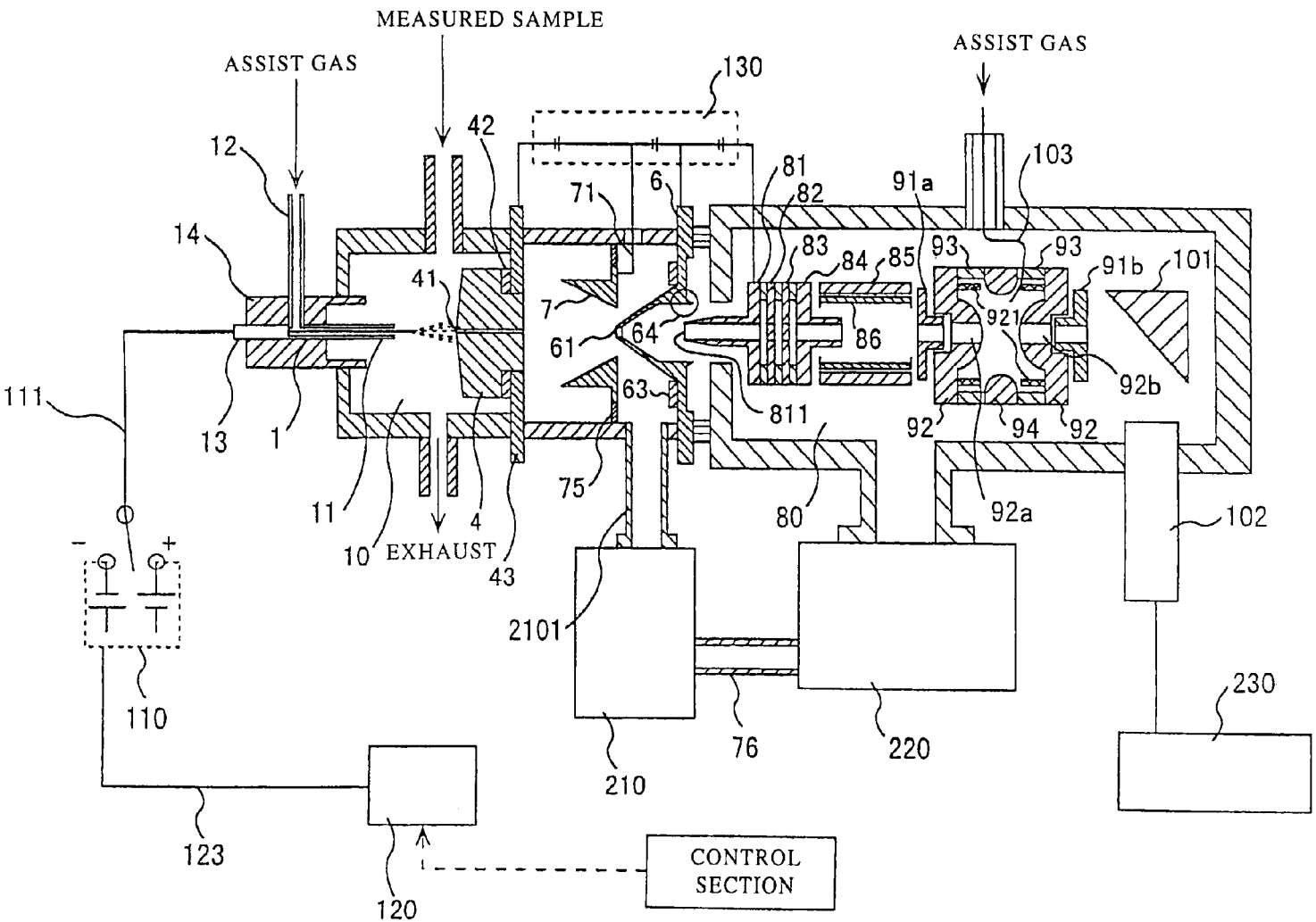
FIG. 12 is an overall view of another embodiment of the invention.

FIG. 12 shows another embodiment of the invention.

The present embodiment differs from the embodiment of FIG. 1 in that the intermediate pore body 5 is eliminated, and that the first chamber 50 is made up only of the space between the first pore 41 and the second pore 61 (namely, there is only one chamber), in which there is only the first converging electrode 7. Further, on the face of the second pore 61 towards the skimmer 81, there is integrally formed a cylindrical projection 64 with a sharp edge. The end of the first converging electrode 7 towards the second pore 61 is disposed close to the tip of the cone of the second pore 61. Alternatively, the tip of the second pore 61 extends into the entry of the first converging electrode 7. The first chamber 50 is exhausted only through a flow channel formed between the first converging electrode 7 and the second pore 61.

The first pore body 4, first converging electrode 7, projection 64, second pore body 6, and second pore 61 are disposed on a linear (common) axis, as shown, and their potential relationships are as follows. In the case of positive ions, the potentials are first pore body 4>first converging electrode 7>second pore body 6. In the case of negative ions, the potentials are first pore body 4<first converging electrode 7<second pore body 6.

In this configuration, there is no deterioration in the ion transmission ratio or the desolvation function; in fact, as the number of parts can be reduced, higher equipment reliability and better economy can be obtained.

Because in the jet region of the first chamber 50 the end of the first converging electrode 7 overlaps the tip of the cone of the second pore 61, the potential line gradient is increased, and the jet is directed towards the tip of the second pore 61. As a result, more stable convergence characteristics and higher transmission ratio can be obtained.

Alternatively, while not shown, the tip of the cone of the second pore 61 may be made to coincide with the tip of the first converging electrode 7, and the tip of the cylindrical projection 64 may be made to coincide with the tip of the skimmer 811, as in the case of the previously described embodiment shown in FIG. 5. In this configuration, too, the potential line gradient is increased and more stable convergence characteristics and higher transmission ratio can be obtained.

Figure 13:
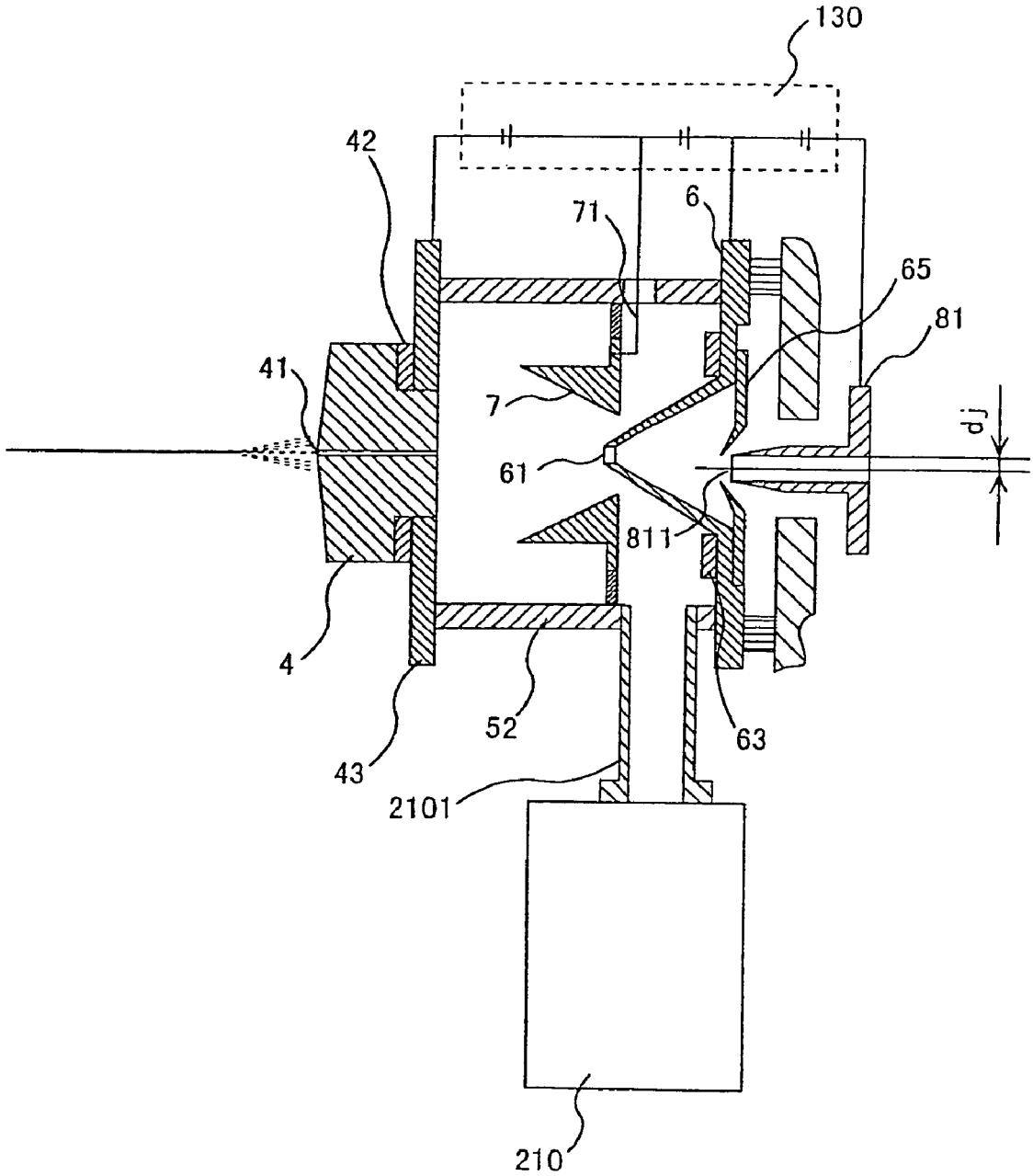
FIG. 13 is a cross section of the interface section (differential exhaust chamber) of another embodiment of the invention.

FIG. 13 shows another embodiment of the invention.

The present embodiment differs from the embodiment of FIG. 12 in that a disc-shaped electrode 65 with a sharpened internal edge is provided on the plane of the second pore 61 towards the skimmer 811.

The end of the first converging electrode 7 towards the second pore 61 is disposed close to the tip of the cone of the second pore 61, or the tip of the second pore 61 is extended towards the entry of the first converging electrode 7. The first chamber 50 is exhausted only through a flow channel formed between the first converging electrode 7 and the second pore 61.

The disc-shaped electrode 65 may be attached to the second pore body 6 by a conductive connector, as shown in FIG. 8 and 9, or by a separate, new connector, as shown in FIG. 10. The axis (axis 1) of the first converging electrode 7 and the second pore 61 is eccentric with respect to the axis (axis 2) of the disc-shaped electrode 65 and the skimmer 81 (with a displacement dj, as shown). This is so that the neutral molecules remaining in the measured substance can be blocked by the plane of the disc-shaped electrode 65 more effectively.

As the end of the first converging electrode 7 is positioned to overlap the tip of the cone of the second pore 61 in the jet region of the first chamber 50, the potential line gradient is increased and the flow path of the jet is formed towards the tip of the second pore 61. Thus, more stable convergence characteristics can be ensured.

In this configuration, too, there is no reduction in the ion transmission ratio or the desolvation function. Since the number of parts can be reduced, higher equipment reliability and better economy can be obtained.

Further, the generation of noise by neutral molecules can be further reduced, so that a signal with a high S/N ratio can be obtained even when the measured amount is extremely small.

While not shown, the tip of the cone of the second pore 61 may be made to coincide with the tip of the first converging electrode 7, as in the embodiment of FIG. 12, and yet the same function can be obtained. Further, the tip of the disc-shaped electrode 65 may be made to coincide with the tip of the skimmer 81. In this configuration, too, the potential line gradient can be increased, more stable convergence characteristics and a higher transmission ratio can be obtained.

In the previously described configurations of the differential exhaust chamber the pressure in the first chamber 50 and that in the second chamber 60 are determined by the capacity of the discharge pump employed, the diameter of each of the pore provided in each chamber, and the conductance adjusting opening. Alternatively, a pressure varying mechanism may be provided in parts such as the pipes connecting each discharge pump with each chamber (50, 60), so that the conductance can be varied. In this way, the pressure in each chamber can be easily adjusted from the outside, so that the amount of maintenance and adjustment operations that are required can be reduced.

The above-described embodiments of the mass spectrometer of the invention employ an ion trapping mass spectrometer. However, it goes without saying the invention can also be applied to other types of mass spectrometers in similar manner and with similar effects. For example, the invention can be applied to the quadrupole mass spectrometer, in which a high-frequency electric field is applied to four rods for mass spectrometry, and the magnetic-sector type mass spectrometer, in which mass dispersion in a magnetic field is utilized for mass spectrometry.

Thus, in accordance with the invention, ions can be converged efficiently and the cluster ions produced by neutral molecules or droplets contained in the sample substance can be reduced. Accordingly, the converging rate of measured ions can be improved and microanalysis can be performed with a high S/N ratio.

The invention claimed is:

1. A mass spectrometer comprising:

an ionization section for ionizing a sample at substantially atmospheric pressure;

a first and a second intermediate pressure section in which the pressure is maintained lower than the pressure in said ionization section;

a high vacuum section in which the pressure is maintained lower than the pressure in said intermediate pressure section and in which a mass spectrometric means for subjecting ions to mass spectrometry is disposed;

a first pore electrode disposed between said ionization section and said first intermediate pressure section;

an intermediate pore electrode disposed between said first intermediate pressure section and said second intermediate pressure section; and a second pore electrode disposed between said second intermediate pressure section and said high vacuum section, wherein:

ions produced in said ionization section are introduced via said first pore electrode, said intermediate pore electrode, and said second pore electrode to said high vacuum section, in which mass spectrometry is performed, and wherein:

a first converging electrode is provided in said first intermediate pressure section, said first converging electrode having an opening towards said first pore electrode and another opening towards said intermediate pore electrode, the opening towards said first pore electrode having a larger diameter than the opening towards said intermediate pore electrode, such that said first converging electrode has a tapered shape.

2. The mass spectrometer according to claim 1, wherein:

the diameter of the opening of said first converging electrode towards said first pore electrode is not less than the diameter of a Mach disc produced in at least said intermediate pressure section, and the diameter of the opening of said first converging electrode towards said first pore electrode is more towards said intermediate pore electrode than a Mach disc plane produced in said first intermediate pressure section.

3. The mass spectrometer according to claim 1, wherein a second converging electrode is provided in said second intermediate pressure section, said second converging electrode having a cylindrical shape and having the edge towards said second pore electrode formed with an acute angle.

4. The mass spectrometer according to claim 3, wherein:

the internal diameter of said second converging electrode is not less than the diameter of a Mach disc produced in said second intermediate pressure section, and the diameter of the opening towards said second pore electrode extends more towards said second pore electrode than a Mach disc plane produced in said second intermediate pressure section.

5. The mass spectrometer according to claim 3, wherein:

said second converging electrode is formed integrally with said intermediate pore electrode.

6. The mass spectrometer according to claims 2 or 4, wherein:

the diameter of the opening of said first converging electrode towards the intermediate pore electrode is extended more towards said second pore electrode than the position of a pore provided in said intermediate pore electrode, the diameter of the opening of said second converging electrode towards said second pore electrode is extended more towards said high vacuum section than the position of a pore provided in said second pore electrode.

7. The mass spectrometer according to claim 1 or 3, wherein:

said first converging electrode and said second converging electrode are formed by a hollow disc.

8. A mass spectrometer comprising:

an ionization section for ionizing a sample at substantially atmospheric pressure;

a first and a second intermediate pressure section in which the pressure is maintained lower than the pressure in said ionization section;

a high vacuum section in which the pressure is maintained lower than the pressure in said intermediate pressure section and in which a mass spectrometric means for subjecting ions to mass spectrometry is disposed;

a first pore electrode disposed between said ionization section and said first intermediate pressure section;

an intermediate pore electrode disposed between said first intermediate pressure section and said second intermediate pressure section; and a second pore electrode disposed between said second intermediate pressure section and said high vacuum section, wherein:

ions produced in said ionization section are introduced via said first pore electrode, said intermediate pore electrode, and said second pore electrode to said high vacuum section, in which mass spectrometry is performed;

a first converging electrode is provided in said first intermediate pressure section, said first converging electrode having an opening towards said first pore electrode and another opening towards said intermediate pore electrode, wherein the diameter of the opening towards said first pore electrode is larger than that of the opening towards said intermediate pore electrode such that said first converging electrode has a tapered shape and;

a disc-shaped second converging electrode having an opening is provided in said second intermediate pressure section;

said intermediate pore electrode and said second pore electrode are disposed on different axes; and said second converging electrode has a central axis that is aligned with the central axis of said second pore electrode.

9. A mass spectrometer comprising:

an ionization section for ionizing a sample at substantially atmospheric pressure;

a first and a second intermediate pressure section in which the pressure is maintained lower than the pressure in said ionization section;

a high vacuum section in which the pressure is maintained lower than the pressure in said intermediate pressure section and in which a mass spectrometric means for subjecting ions to mass spectrometry is disposed;

a first pore electrode disposed between said ionization section and said first intermediate pressure section;

an intermediate pore electrode disposed between said first intermediate pressure section and said second intermediate pressure section; and a second pore electrode disposed between said second intermediate pressure section and said high vacuum section, wherein:

ions produced in said ionization section are introduced via said first pore electrode, said intermediate pore electrode, and said second pore electrode to said high vacuum section, in which mass spectrometry is performed;

a first converging electrode is provided in said first intermediate pressure section, said first converging electrode having an opening towards said first pore electrode and another opening towards said intermediate pore electrode, wherein the diameter of the opening towards said first pore electrode is larger than that of the opening towards said intermediate pore electrode such that said first converging electrode has a tapered shape;

a second converging electrode and a third converging electrode are provided in said second intermediate pressure section, said second converging electrode and said third converging electrode each having an opening and a disc shape;

said intermediate pore electrode and said second pore electrode are displaced on different central axes; and said second converging electrode has a central axis that is aligned with the central axis of said intermediate pore electrode, and said third converging electrode is disposed in alignment with the central axis of said second pore electrode.

10. A mass spectrometer comprising:

an ionization section for ionizing a sample with corona electric discharge produced by a needle electrode at substantially atmospheric pressure;

an intermediate pressure section in which the pressure is maintained to be lower than the pressure in said ionization section;

a high vacuum section in which the pressure is maintained to be lower than the pressure in said ionization section and in which a mass spectrometric means for subjecting ions to mass spectrometry is disposed; and a pore electrode body disposed between said ionization section and said intermediate pressure section, said pore electrode body having a pore through which ions can pass through, wherein:

said pore electrode body comprising a spherical concave portion towards said ionization section; and said needle electrode is disposed such that its tip is positioned within said concave portion.

11. The mass spectrometer according to claim 10, wherein:

said pore electrode body comprises a plurality of pores towards said ionization section and a pore towards said intermediate pressure section, wherein communication is provided between said plurality of pores towards said ionization section and said opening towards said intermediate pressure section.

12. A mass spectrometer comprising:

an ionization section for ionizing a sample at substantially atmospheric pressure;

an intermediate pressure section in which the pressure is maintained to be lower than the pressure in said ionization section;

a high vacuum section in which the pressure is maintained to be lower than the pressure in said intermediate pressure section and in which an electrostatic lens for converging ions and a mass spectrometric means for subjecting ions to mass spectrometry are disposed;

a first pore electrode disposed between said ionization section and said intermediate pressure section; and a second pore electrode disposed between said intermediate pressure section and said high vacuum section, wherein ions produced in said ionization section are introduced via said first pore electrode and said second pore electrode to said high vacuum section in which mass spectrometry is performed, wherein:

a converging electrode is provided in said intermediate pressure section, said converging electrode comprising an opening towards said first pore electrode and another opening towards said second pore electrode, wherein the diameter of the opening towards said first pore electrode is larger than the diameter of the opening towards said second pore electrode, such that said converging electrode has a tapered shape.

13. The mass spectrometer according to claim 12, wherein:

the diameter of the opening of said converging electrode towards said first pore electrode is not less than the diameter of a Mach disc produced in at least said first intermediate pressure section; and the diameter of the opening of said converging electrode towards said first pore electrode is disposed more towards said intermediate pore electrode than a Mach disc plane produced in said first intermediate pressure section.

14. The mass spectrometer according to claim 12, wherein:

a disc-shaped electrode with an opening is provided in said second pore electrode towards said high vacuum section;

said second pore electrode and said electrostatic lens are disposed on different central axes; and said disc-shaped electrode has a central axis that is aligned with the central axis of said electrostatic lens.

15. A mass spectrometer comprising:

an ionization section for ionizing a sample at substantially atmospheric pressure;

a first and a second intermediate pressure section in which the pressure is maintained lower than the pressure in said ionization section;

a high vacuum section in which the pressure is maintained lower than the pressure in said intermediate pressure section and in which a mass spectrometric means for subjecting ions to mass spectrometry is disposed;

a first pore electrode disposed between said ionization section and said first intermediate pressure section; and an intermediate pore electrode disposed between said first intermediate pressure section and said second intermediate pressure section, wherein ions produced in said ionization section are introduced to said high vacuum section, in which mass spectrometry is performed, and wherein:

a first converging electrode is provided in said first intermediate pressure section, said first converging electrode comprising an opening towards said first pore electrode and anther opening towards said intermediate pore electrode; and the gap between the opening of said first converging electrode towards said first pore electrode and said first pore electrode is not less than a distance that is determined by the diameter of the pore of said first pore electrode, the pressure in said first intermediate pressure section, and the value of atmospheric pressure.

16. The mass spectrometer according to claim 15, wherein the size of the opening of said first converging electrode towards said first pore electrode is not less than a diameter that is determined by the diameter of the pore of said first pore electrode, the pressure in said first intermediate pressure section, and the value of atmospheric pressure.

17. The mass spectrometer according to claim 16, wherein said first converging electrode has a tapered shape such that the diameter towards said first pore electrode is larger than the diameter of the opening towards said intermediate pore electrode.

* * * * *